US010038234B2

(12) United States Patent
Tseng et al.

(10) Patent No.: US 10,038,234 B2
(45) Date of Patent: Jul. 31, 2018

(54) ANTENNA STRUCTURE AND WIRELESS COMMUNICATION DEVICE USING SAME

(71) Applicant: Chiun Mai Communication Systems, Inc., New Taipei (TW)

(72) Inventors: Yu-Kai Tseng, New Taipei (TW); Kuo-Lun Huang, New Taipei (TW); Ming-Yu Chou, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/653,679

(22) Filed: Jul. 19, 2017

(65) Prior Publication Data

US 2018/0026353 A1 Jan. 25, 2018

Related U.S. Application Data

(60) Provisional application No. 62/382,762, filed on Sep. 1, 2016, provisional application No. 62/364,881, filed on Jul. 21, 2016.

(30) Foreign Application Priority Data

Jun. 22, 2017 (CN) ..... 2017 1 0482507

(51) Int. Cl.

| | |
|---|---|
| ***H01Q 1/24*** | (2006.01) |
| ***H01Q 13/10*** | (2006.01) |
| ***H01Q 5/371*** | (2015.01) |
| ***H01Q 5/10*** | (2015.01) |

(52) U.S. Cl.

CPC ..... *H01Q 1/243* (2013.01); *H01Q 5/10* (2015.01); *H01Q 5/371* (2015.01); *H01Q 13/10* (2013.01)

(58) Field of Classification Search

CPC ..... H01Q 13/10; H01Q 1/243; H01Q 5/10; H01Q 5/371

See application file for complete search history.

(56) References Cited

U.S. PATENT DOCUMENTS

| | | | | |
|---|---|---|---|---|
| 8,842,048 | B2 * | 9/2014 | Kim | H01Q 1/243 343/702 |
| 8,954,122 | B2 * | 2/2015 | Wilmhoff | H01Q 1/245 342/375 |
| 9,035,840 | B1 * | 5/2015 | Lee | H01Q 1/243 343/702 |
| 9,105,968 | B2 * | 8/2015 | Hong | H01Q 1/243 |
| 9,124,679 | B2 * | 9/2015 | Ash, Jr. | H01Q 1/243 |

(Continued)

*Primary Examiner* — Lewis West

(74) *Attorney, Agent, or Firm* — ScienBiziP, P.C.

(57) ABSTRACT

An antenna structure includes a housing, a first feed portion, a first ground portion, and a second ground portion. The housing defines a slot, a first groove, and a gap. The housing is divided into a first portion and a second portion by the slot, the first groove, and the gap. The first portion is further divided into a first radiating portion and a second radiating portion by the first feed portion. A first portion of the housing extending from the first feed portion to the first gap forms the first radiating portion. A second portion of the housing extending from the first feed portion to the groove forms the second radiating portion. The second radiating portion is shorter than the second portion. The second portion is shorter than the first radiating portion. The first portion activates a first operation mode and the second portion activates a second operation mode.

42 Claims, 27 Drawing Sheets

(56) References Cited

U.S. PATENT DOCUMENTS 9,196,952 B2 * 11/2015 Tran ..... H01Q 1/243
9,337,528 B2 * 5/2016 Hammond ..... H01Q 1/243
9,397,727 B1 * 7/2016 Mattsson ..... H04B 5/0081
9,462,096 B2 * 10/2016 Han ..... H01Q 1/243
9,509,041 B2 * 11/2016 Yan ..... H01Q 1/1207
9,578,769 B2 * 2/2017 Woodhull ..... B23P 11/00
9,673,507 B2 * 6/2017 Ramachandran ..... H01Q 1/243
9,730,312 B2 * 8/2017 Dumpit ..... H05K 1/0215
9,768,492 B2 * 9/2017 Kim ..... H01Q 1/243
9,832,295 B2 * 11/2017 Ash, Jr. ..... H04M 1/026
2012/0206302 A1 * 8/2012 Ramachandran ..... H01Q 1/24
343/702
2014/0300518 A1 * 10/2014 Ramachandran ..... H01Q 1/243
343/702
2015/0340757 A1 * 11/2015 Rho ..... H01Q 1/46
343/702
2015/0372372 A1 * 12/2015 Lee ..... H01Q 1/243
343/702
2017/0194709 A1 * 7/2017 Jansson ..... H01Q 7/00
2018/0026343 A1 * 1/2018 Lee ..... H01Q 1/243
2018/0026344 A1 * 1/2018 Lee ..... H01Q 1/243
2018/0026345 A1 * 1/2018 Lee ..... H01Q 1/243
2018/0026346 A1 * 1/2018 Lee ..... H01Q 1/243
455/575.7
2018/0026347 A1 * 1/2018 Lee ..... H01Q 5/10
2018/0026348 A1 * 1/2018 Lee ..... H01Q 1/243
2018/0026349 A1 * 1/2018 Lee ..... H01Q 1/243
2018/0026350 A1 * 1/2018 Hung ..... H01Q 1/243
2018/0026351 A1 * 1/2018 Tsai ..... H01Q 1/243
2018/0026354 A1 * 1/2018 Lin ..... H01Q 1/243
2018/0026355 A1 * 1/2018 Lee ..... H01Q 1/243
2018/0026360 A1 * 1/2018 Lee ..... H01Q 1/42
2018/0026370 A1 * 1/2018 Lee ..... H01Q 5/371
2018/0062244 A1 * 3/2018 Huang ..... H01Q 1/243
2018/0062270 A1 * 3/2018 Liang ..... H01Q 13/106

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201710482507.9 filed on Jun. 22, 2017, claims priority to U.S. Patent Application No. 62/364,881 filed on Jul. 21, 2016, and claims priority to U.S. Patent Application No. 62/382,762 filed on Sep. 1, 2016, the contents of which are incorporated by reference herein.

FIELD

The subject matter herein generally relates to an antenna structure and a wireless communication device using the antenna structure.

BACKGROUND

Antennas are important elements of wireless communication devices, such as mobile phones or personal digital assistants. To communicate in multi-band communication systems, a bandwidth of an antenna in the wireless communication device needs to be wide enough to cover frequency bands of multiple bands. In addition, because of the miniaturization of the wireless communication device, space available for the antenna is reduced and limited.

BRIEF DESCRIPTION OF THE DRAWINGS

Implementations of the present technology will now be described, by way of example only, with reference to the attached figures.

DETAILED DESCRIPTION

Figure 1:
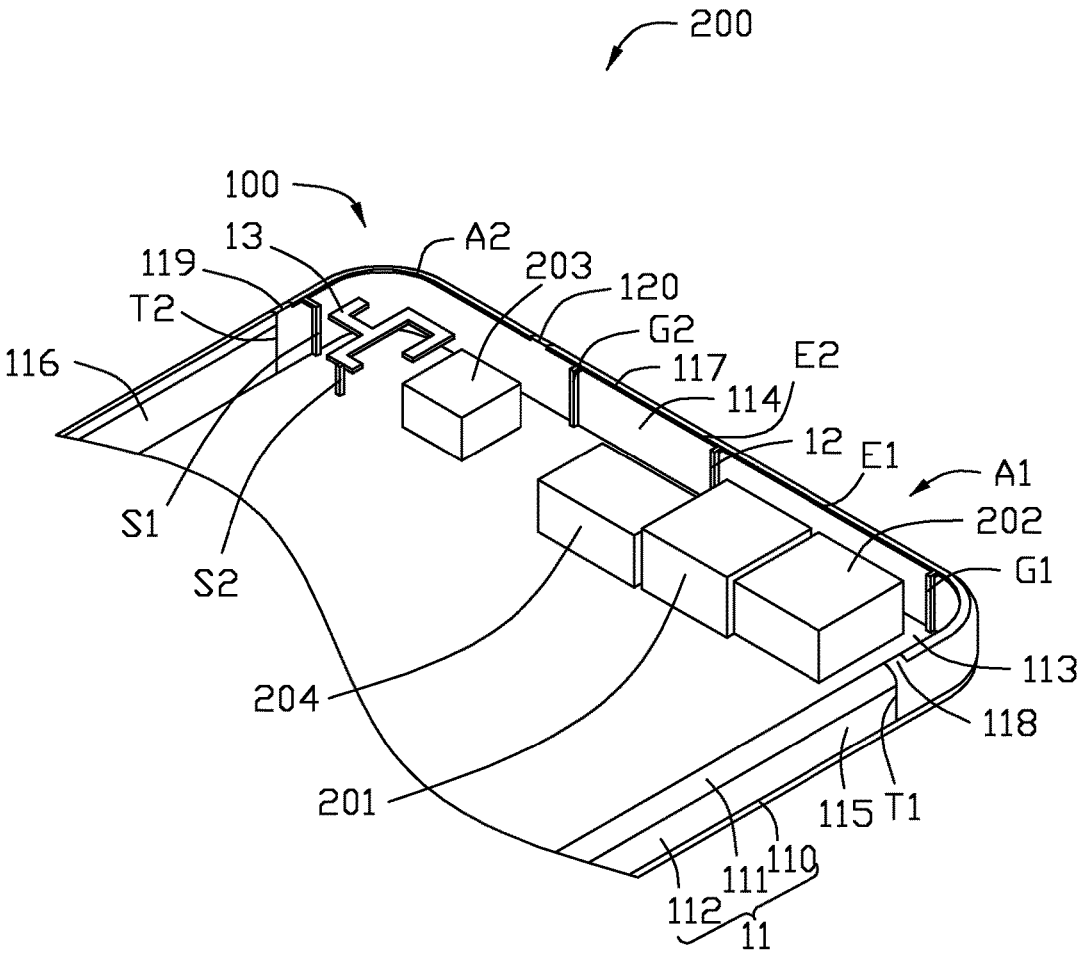
FIG. 1 is an isometric view of a first exemplary embodiment of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

Exemplary Embodiments 1-3

FIG. 1 illustrates an embodiment of a wireless communication device 200 using a first exemplary antenna structure 100. The wireless communication device 200 can be a mobile phone or a personal digital assistant, for example. The antenna structure 100 can receive and send wireless signals.

The antenna structure 100 includes a housing 11, a first feed portion 12, a first ground portion G1, a second ground portion G2, a radiator 13, and two second feed portions S1, S2. The housing 11 includes a backboard 110, a front frame 111, and a side frame 112. The backboard 110 can be made of metallic or insulation material. The front frame 111 and the side frame 112 are both made of metallic material. The front frame 111 and the side frame 112 can be integral with each other. The backboard 110 is positioned opposite to the front frame 111. The backboard 110, the front frame 111, and the side frame 112 cooperatively form the housing of the wireless communication device 200.

The side frame 112 is positioned between the backboard 110 and the front frame 111. The side frame 112 is positioned around a periphery of the backboard 110 and a periphery of the front frame 111. The side frame 112 forms a receiving space 113 together with the backboard 110 and the front frame 111. The receiving space 113 can receive a printed circuit board, a processing unit, or other electronic components or modules.

The side frame 112 includes an end portion 114, a first side portion 115, and a second side portion 116. In this exemplary embodiment, the end portion 114 can be a top portion or a bottom portion of the wireless communication device 200. The end portion 114 connects the front frame 111. The first side portion 115 is positioned apart from and parallel to the second side portion 116. The end portion 114 has first and second ends. The first side portion 115 is connected to the first end of the first frame 111 and the second side portion 116 is connected to the second end of the end portion 114. The first side portion 115 and the second side portion 116 both connect to the front frame 111.

The side frame 112 defines a slot 117. In this exemplary embodiment, the slot 117 is defined at the end portion 114 and extends to the first side portion 115 and the second portion 117. The front frame 111 defines a first gap 118, a second gap 119, and a groove 120. The first gap 118, the second gap 119, and the groove 120 all communicate with the slot 117 and extend across the front frame 111. In this exemplary embodiment, the first gap 118 is defined on the front frame 111 and communicates with a first end T1 of the slot 117 positioned on the first side portion 115. The second gap 119 is defined on the front frame 111 and communicates with a second end T2 of the slot 117 positioned on the second side portion 116. The groove 120 is positioned at a portion of the front frame 111 between the first end T1 and the second end T2. The housing 11 is divided into two portions by the slot 117, the first gap 118, the second gap 119, and the groove 120. The two portions are a first portion A1 and a second portion A2. A first portion of the front frame 111 surrounded by the slot 117, the first gap 118, and the groove 120 forms the first portion A1. A second portion of the front frame 111 surrounded by the slot 117, the second gap 119, and the groove 120 forms the second portion A2.

In other exemplary embodiments, a width of the slot 117 is about 3.5 mm. A width of the first gap 118 and a width of the second gap 119 are both about 3.5 mm. A width of the groove 120 is about 1.5 mm.

In this exemplary embodiment, the slot 117 is defined on the end of the side frame 112 and extends to the front frame 111. Then the first portion A1 and the second portion A2 are fully formed by a portion of the front frame 111. In other exemplary embodiments, a position of the slot 117 can be adjusted. For example, the slot 117 can be defined on the end of the side frame 112 away from the front frame 111. Then the first portion A1 and the second portion A2 are formed by a portion of the front frame 111 and a portion of the side frame 112.

In other exemplary embodiments, the slot 117 is defined only at the end portion 114 and does not extend to any one of the first side portion 115 and the second portion 117. In other exemplary embodiments, the slot 117 can be defined at the end portion 114 and extend to one of the first side portion 115 and the second portion 117. Then, locations of the first end T1 and the second end T2 and locations of the first gap 118 and the second gap 119 can be adjusted according to a position of the slot 117. For example, one of the first end T1 and the second end T2 can be positioned at a location of the front frame 111 corresponding to the end portion 114. The other one of the first end T1 and the second end T2 is positioned at a location of the front frame 111 corresponding to the first side portion 115 or the second side portion 116. That is, a shape and a location of the slot 117, locations of the first end T1 and the second end T2 on the side frame 112 can be adjusted, to ensure that the housing 11 can be divided into the first portion A1 and the second portion A2 by the slot 117, the first gap 118, the second gap 119, and the groove 120.

In this exemplary embodiment, the second portion A2 of the antenna structure 100 is grounded. For example, one end of the second portion A2 adjacent to the second gap 119 can be electrically connected to a ground plane of the wireless communication device 200 through a line or other connecting structure, to ground the second portion A2.

The wireless communication device 200 can include a display. The display can be positioned at an opening of the front frame 111 and thus closes the receiving space 113. In other exemplary embodiments, the wireless communication device 200 further includes a shielding mask or a middle frame (not shown). The shielding mask is positioned at the surface of the display towards the backboard 110 and shields against electromagnetic interference. The middle frame is positioned at the surface of the display towards the backboard 110 and supports the display. The shielding mask or the middle frame is made of metallic material. The ground plane can be the backboard 110 of the wireless communication device 200, the shielding mask, or the middle frame. The ground plane can also be formed through the shielding mask or the middle frame being electrically connected to the backboard 110. The ground plane is the ground connection of the antenna structure 100 and wireless communication device 200.

One end of the first feed portion 12 is electrically connected to a portion of the first portion A1 adjacent to the groove 120, to feed current to the first portion A1. In this exemplary embodiment, the first portion A1 is divided into two portions by the first feed portion 12. The two portions include a first radiating portion E1 and a second radiating portion E2. A first portion extending from the first feed portion 12 to a portion of the front frame 111 defining the first gap 118 forms the first radiating portion E1. A second portion extending from the first feed portion 12 to a portion of the front frame 111 defining the groove 120 forms the second radiating portion E2.

In this exemplary embodiment, the first feed portion 12 is not positioned at a middle portion of the first portion A1. The first radiating portion E1 is longer than the second radiating portion E2. The second portion A2 is longer than the second radiating portion E2. The second portion A2 is shorter than the first radiating portion E1.

The first ground portion G1 is electrically connected to the first radiating portion E1 and is electrically connected to the ground plane for grounding the first radiating portion E1. The second ground portion G2 is electrically connected to the second radiating portion E2 and is electrically connected to the ground plane for grounding the second radiating portion E2. In this exemplary embodiment, the first ground portion G1 is positioned at the end of the first radiating portion E1 adjacent to the first gap 118. The first ground portion G1 is positioned at a right corner of the housing 11. The second ground portion G2 is positioned between the groove 120 and the first feed portion 12.

In this exemplary embodiment, the slot 117, the first gap 118, the second gap 119, and the groove 120 are all filled with insulating material, for example, plastic, rubber, glass, wood, ceramic, or the like, thereby isolating the first radiating portion E1, the second radiating portion E2, the second portion A2, and the other parts of the housing 11.

In this exemplary embodiment, one of the two second feed portions, for example the second feed portion S1, is electrically connected to the second portion A2 to feed current to the second portion A2. The other of the two second feed portions, for example the second feed portion S2, is electrically connected to the radiator 13 to feed current to the radiator 13.

Figure 2:
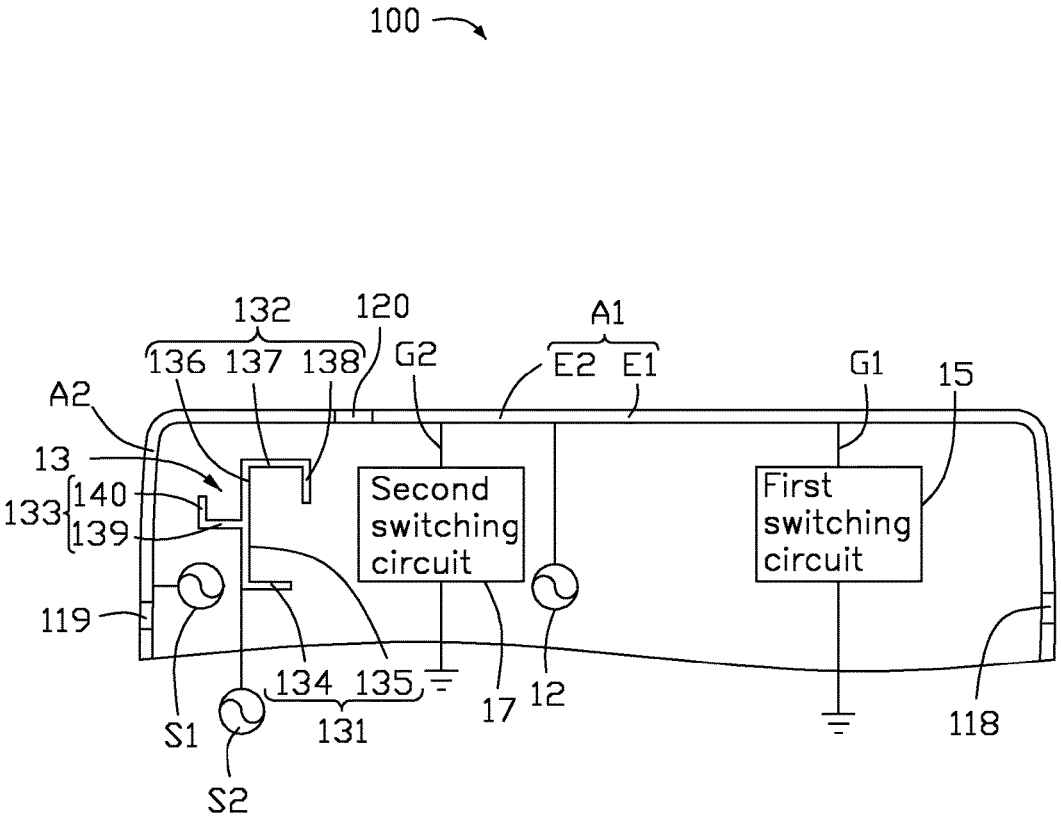
FIG. 2 is similar to FIG. 1, but shown from another angle.

Per FIG. 2, in this exemplary embodiment, the radiator 13 is positioned in the receiving space 113 adjacent to the second portion A2. The radiator 13 can be a flexible printed circuit (FPC) or formed through laser direct structuring (LDS). The radiator 13 includes a connecting portion 131, a first branch 132, and a second branch 133. The connecting portion 131 is coplanar with the first branch 132 and the second branch 133.

The connecting portion 131 is substantially L-shaped and includes a first connecting section 134 and a second connecting section 135. The first connecting section 134 is electrically connected to the second feed portion S2 and is positioned parallel to the end portion 114 to feed current to the radiator 13. One end of the second connecting section 135 is perpendicularly connected to the end of the first connecting section 134 adjacent to the second side portion 116. Another end of the second connecting section 135 extends along a direction parallel to the second portion 116 adjacent to the end portion 114 and forms the L-shaped structure with the first connecting section 134.

The first branch 132 includes a first extending section 136, a second extending section 137, and a third extending section 138. The first extending section 13 is substantially rectangular. The first extending section 136 is connected to the end of the second connecting section 135 away from the first connecting section 134 and extends along a direction perpendicular to and away from the first connecting section 134, so as to be collinear with the second connecting section 135. The second extending section 137 is substantially rectangular. One end of the second extending section 137 is perpendicularly connected to the end of the first extending section 136 away from the second connecting section 135. Another end of the second extending section 137 extends along a direction parallel to the first connecting section 134 away from the first extending section 136. The second extending section 137 and the first connecting section 134 are positioned at a same side of the second connecting section 135 and the first extending section 136. The second extending section 137 and the first connecting section 134 are positioned at two ends of the second connecting section 135 and the first extending section 136.

The third extending section 138 is substantially rectangular. One end of the third extending section 138 is electrically connected to the end of the second extending section 137 away from the first extending section 136. Another end of the third extending section 138 extends along a direction parallel to the second connecting section 135 towards the first connecting section 134.

The second branch 133 is substantially L-shaped and includes a first resonance section 139 and a second resonance section 140. One end of the first resonance section 139 is perpendicularly connected to a junction of the second connecting section 135 and the first extending section 136. Another end of the first resonance section 139 extends along a direction parallel to the first connecting section 134 towards the second side portion 116. The second resonance section 140 is substantially rectangular. One end of the second resonance section 140 is perpendicularly connected to the end of the first resonance section 139 away from the second connecting section 135 and the first extending section 136. Another end of the second resonance section 140 extends along a direction perpendicular to the first resonance section 139 towards the second extending section 137 to form the L-shaped structure with the first resonance section 139.

In this exemplary embodiment, the first portion A1 is a diversity antenna. The second portion A2 is a GPS antenna. The radiator 13 is a WIFI antenna. The first portion A1, the first feed portion 12, the first ground portion G1, and the second ground portion G2 cooperatively form a dual inverted-F antenna structure to send/receive signals in a first operation mode. The second portion A2 forms a direct-feed and inverted-F antenna structure to send/receive signals in a second operation mode. In this exemplary embodiment, the radiator 13 is an inverted-F antenna to send/receive signals in a third operation mode. In other exemplary embodiments, the radiator 13 can be a loop antenna or other antenna.

In other exemplary embodiments, the portion of the backboard 110 corresponding to the radiator 13 can be made of insulation material and the other portions of the backboard 110 can be made of metallic material to improve a return loss and a radiating efficiency of the radiator 13.

In this exemplary embodiment, the wireless communication device 200 further includes at least one electronic element. In this exemplary embodiment, the wireless communication device 200 includes at least four electronic elements, that is, a first electronic element 201, a second electronic element 202, a third electronic element 203, and a fourth electronic element 204. In this exemplary embodiment, the first electronic element 201 and the second electronic element 202 are both main camera modules. The first electronic element 201 and the second electronic element 202 are positioned between the first feed portion 12 and the first ground portion G1. The first electronic element 201 and the second electronic element 202 are spaced apart from each other. The third electronic element 203 is a front camera module. The third electronic element 203 is positioned between the radiator 13 and the second ground portion G2. The third electronic element 203 is also positioned adjacent to the groove 120. The fourth electronic element 204 is a receiver. The fourth electronic element 204 is positioned between the first feed portion 12 and the second ground portion G2.

Figure 3:
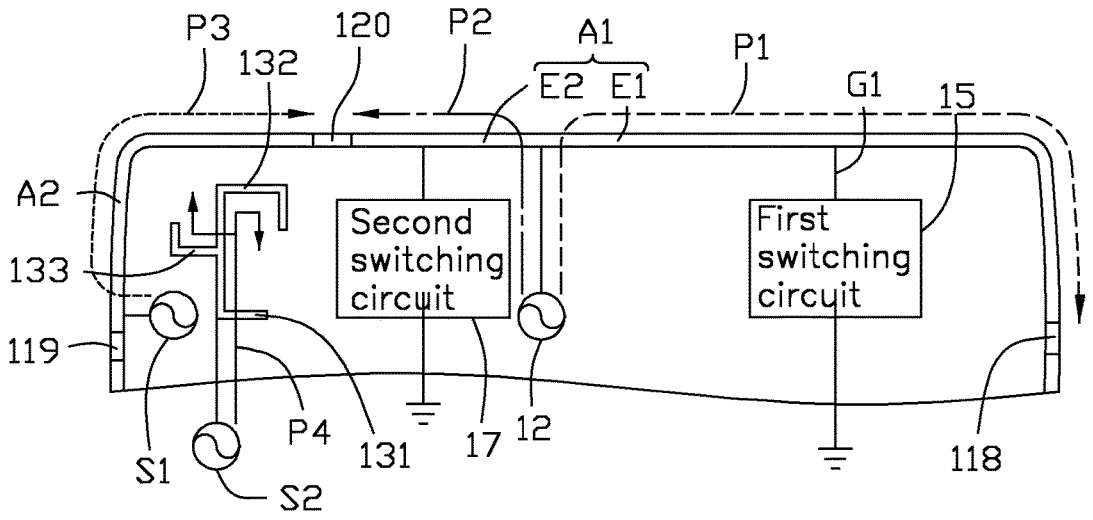
FIG. 3 is a current path distribution graph of the antenna structure of FIG. 1.

Per FIG. 3, when the first feed portion 12 supplies current, the current flows through the first radiating portion E1 and is grounded through the first ground portion G1 (Per path P1). When the first feed portion 12 supplies current, the current flows through the second radiating portion E2 and is grounded through the second ground portion G2 (Per path P2). Then, the first radiating portion E1 and the second radiating portion E2 cooperatively activate a first operation mode to generate radiation signals in a first frequency band. In this exemplary embodiment, the first operation mode is an LTE mode and includes low, middle, and high frequency operation modes. Respective frequency bands of the low, middle, and high frequency operation modes include 734-960 MHz, 1805-2170 MHz, and 2300-2690 MHz. In this exemplary embodiment, the first radiating portion E1 generates radiation signals in the low frequency band. The second radiating portion E2 generates radiation signals in the middle and high frequency bands.

When the second feed portion S1 supplies current, the current flows through the second portion A2 and is grounded through the second portion A2 (Per path P3). Then, the second portion A2 activates a second operation mode to generate radiation signals in a second frequency band, for example, GPS/GLONASS signals (1575-1602 MHz). When the second feed portion S2 supplies current, one portion of the current flows through the connecting portion 131 and the first branch 132. Another portion of the current flows through the connecting portion 131 and the second branch 133 (Per path P4). Then, the radiator 13 activates a third operation mode to generate radiation signals in a third frequency band, for example, WIFI 2.4G mode and WIFI 5G mode.

Per FIG. 2, in other exemplary embodiments, the antenna structure 100 further includes a first switching circuit 15 for improving a bandwidth of the low frequency band of the first radiating portion E1. One end of the first switching circuit 15 is electrically connected to the first radiating portion E1 through the first ground portion G1. Another end of the first switching circuit 15 is electrically connected to the ground plane.

Figure 4:
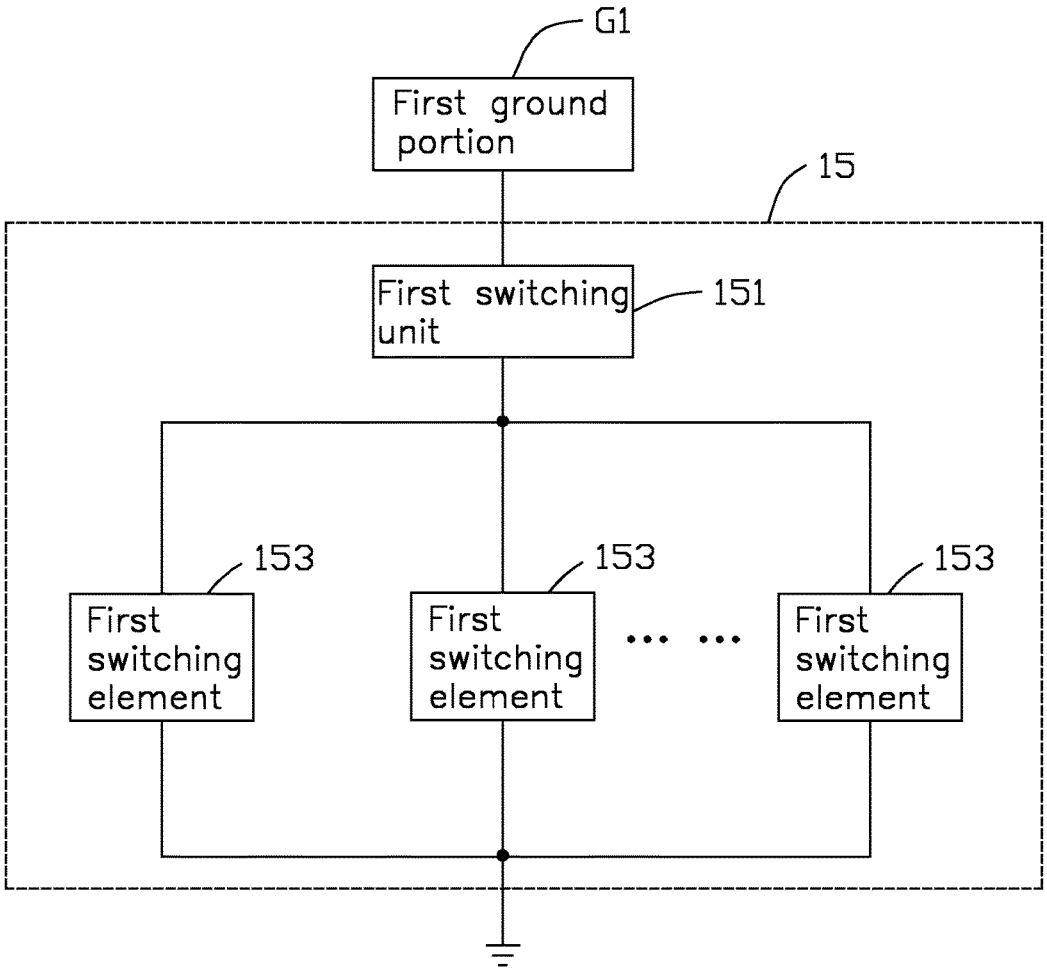
FIG. 4 is a circuit diagram of a first switching circuit of the antenna structure of FIG. 1.

Per FIG. 4, the first switching circuit 15 includes a first switching unit 151 and a plurality of first switching elements 153. The first switching unit 151 is electrically connected to the first ground portion G1 and is electrically connected to the first radiating portion E1 through the first ground portion G1. The first switching elements 153 can be an inductor, a capacitor, or a combination of the inductor and the capacitor. The first switching elements 153 are connected in parallel to each other. One end of each first switching element 153 is electrically connected to the first switching unit 151. The other end of each first switching element 153 is electrically grounded to the ground plane.

Through control of the first switching unit 151, the first radiating portion E1 can be switched to connect with different first switching elements 153. Since each first switching element 153 has a different impedance, an operating frequency band of the LTE low frequency band of the first radiating portion E1 can be adjusted.

Per FIG. 2, in other exemplary embodiments, the antenna structure 100 further includes a second switching circuit 17 for improving a bandwidth of the middle and high frequency bands of the second radiating portion E2. One end of the second switching circuit 17 is electrically connected to the second radiating portion E2 through the second ground portion G2. Another end of the second switching circuit 17 is electrically connected to the ground plane.

Figure 5:
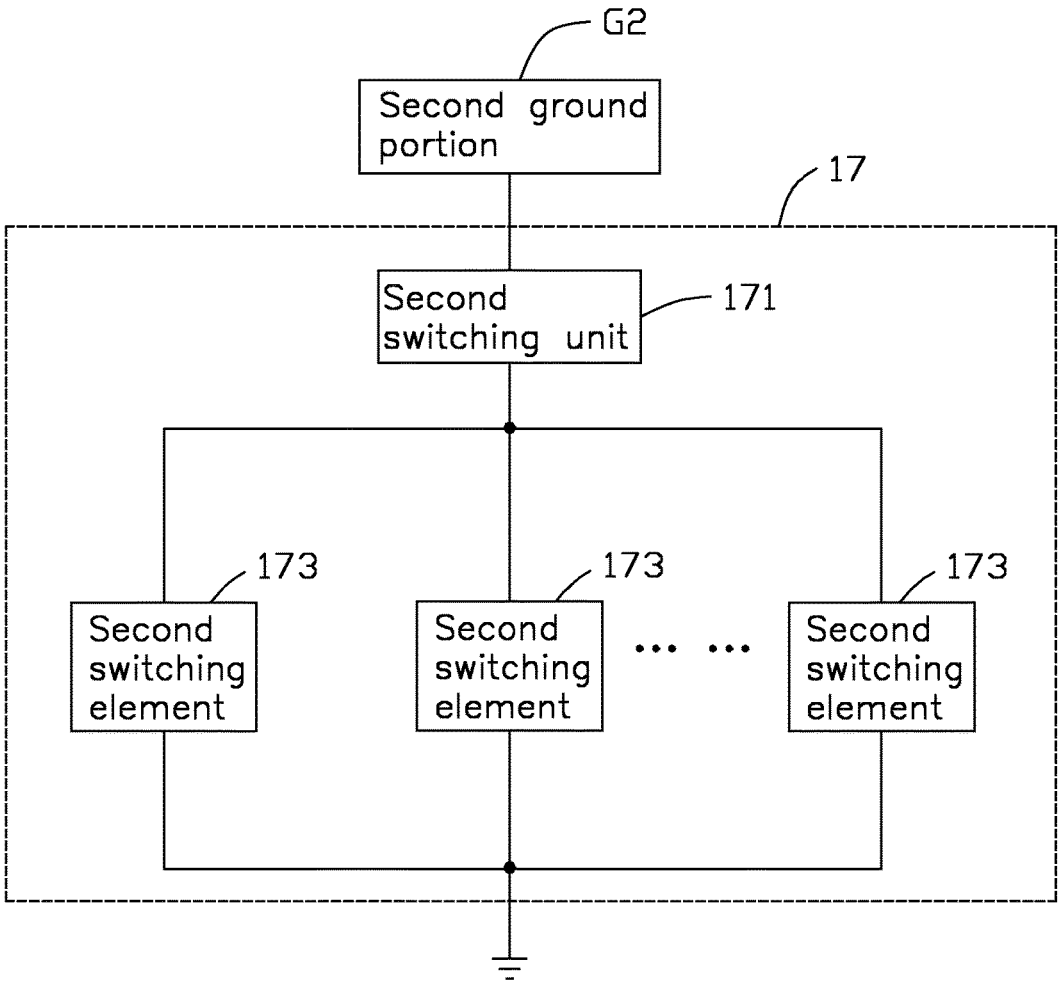
FIG. 5 is a circuit diagram of a second switching circuit of the antenna structure of FIG. 1.

Per FIG. 5, the second switching circuit 17 includes a second switching unit 171 and a plurality of second switching elements 173. The second switching unit 171 is electrically connected to the second ground portion G2 and is electrically connected to the second radiating portion E1 through the second ground portion G2. The second switching elements 173 can be an inductor, a capacitor, or a combination of the inductor and the capacitor. The second switching elements 173 are connected in parallel to each other. One end of each second switching element 173 is electrically connected to the second switching unit 171. The other end of each second switching element 173 is electrically grounded to the ground plane.

Through control of the second switching unit 171, the second radiating portion E2 can be switched to connect with different second switching elements 173. Since each second switching element 173 has a different impedance, an operating frequency band of the LTE middle and high frequency bands of the second radiating portion E2 can be adjusted.

As described above, the first portion A1 activates a first operation mode to generate radiation signals in LTE low, middle, and high frequency bands. The second portion A2 activates a second operation mode to generate radiation signals in GPS/GLONASS frequency band. The radiator 13 activates a third operation mode to generate radiation signals in WIFI 2.4G/5G frequency band. The wireless communication device 200 can use carrier aggregation (CA) technology of LTE-A to receive or send wireless signals at multiple frequency bands simultaneously. In detail, the wireless communication device 200 can use the CA technology and use the antenna structure 100 (for example, the first portion A1) to receive or send wireless signals at multiple frequency bands simultaneously, that is, can realize 2CA or 3CA simultaneously.

Figure 6:
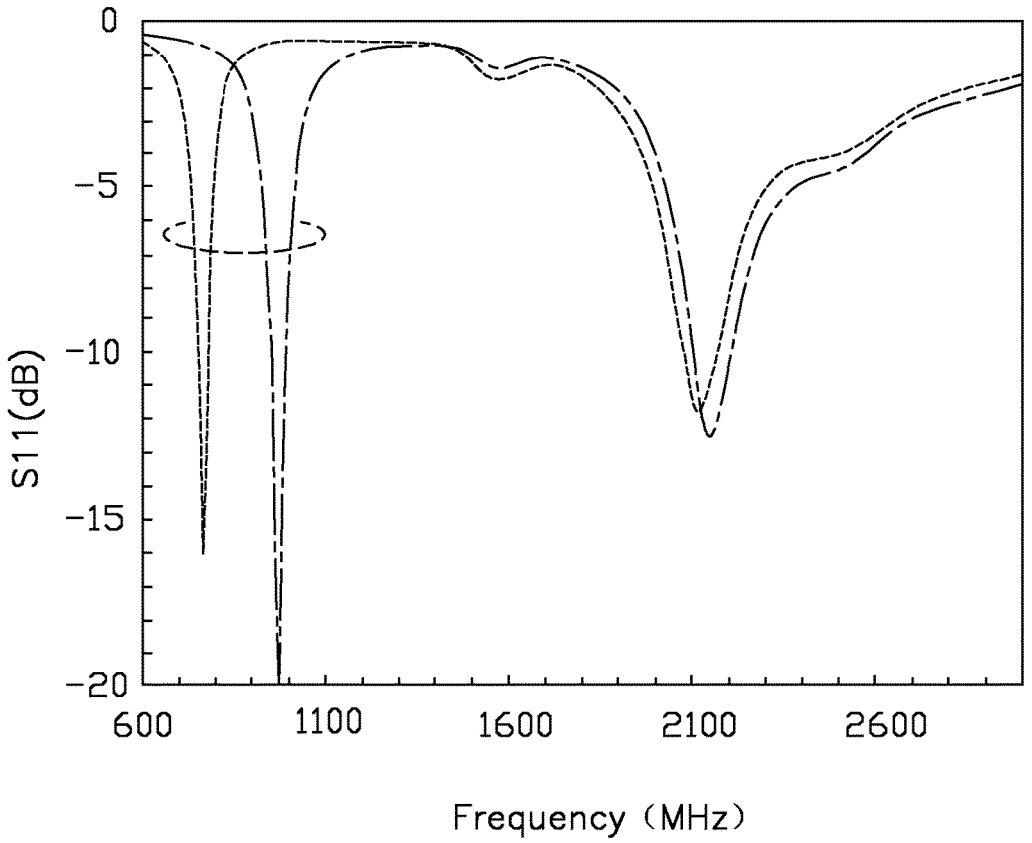
FIG. 6 is a scattering parameter graph illustrating a first switching unit of the first switching circuit of FIG. 4 switching to different first switching elements.

FIG. 6 illustrates a scattering parameter graph of the antenna structure 100 when the first switching unit 151 of the first switching circuit 15 switches to different first switching elements 153. The first switching unit 151 of the first switching circuit 15 can switch to different first switching elements 153 (for example two different first switching elements 153). Since each first switching element 153 has a different impedance, an operating frequency band of the LTE low frequency band of the antenna structure 100 can be adjusted thereby.

Figure 7:
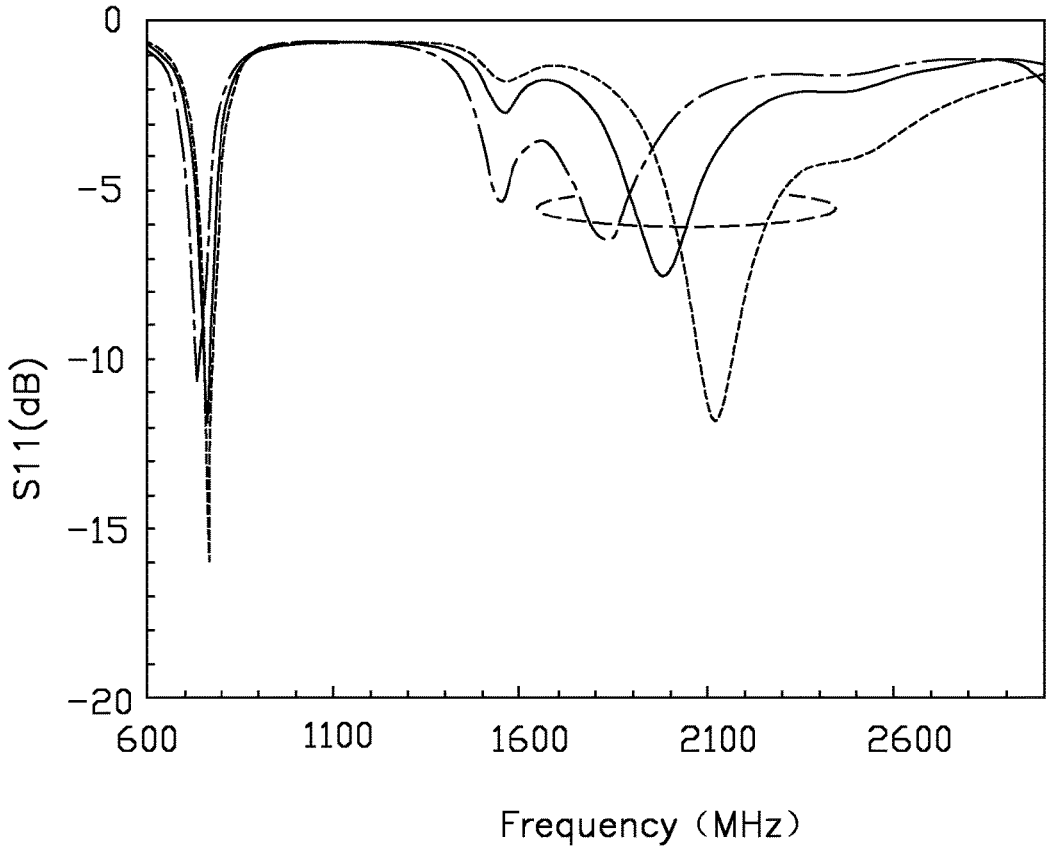
FIG. 7 is a scattering parameter graph illustrating a second switching unit of the second switching circuit of FIG. 5 switching to different second switching elements.

FIG. 7 is a scattering parameter graph of when the second switching unit 171 of the second switching circuit 17 switches to different second switching elements 173. When the second switching unit 171 of the second switching circuit 17 switches to different second switching elements 173 (for example three different second switching elements 173), each second switching element 173 has a different impedance. Therefore, an operating frequency band of the LTE middle and high frequency bands of the antenna structure 100 can be adjusted through the switching of the second switching unit 171.

Figure 8:
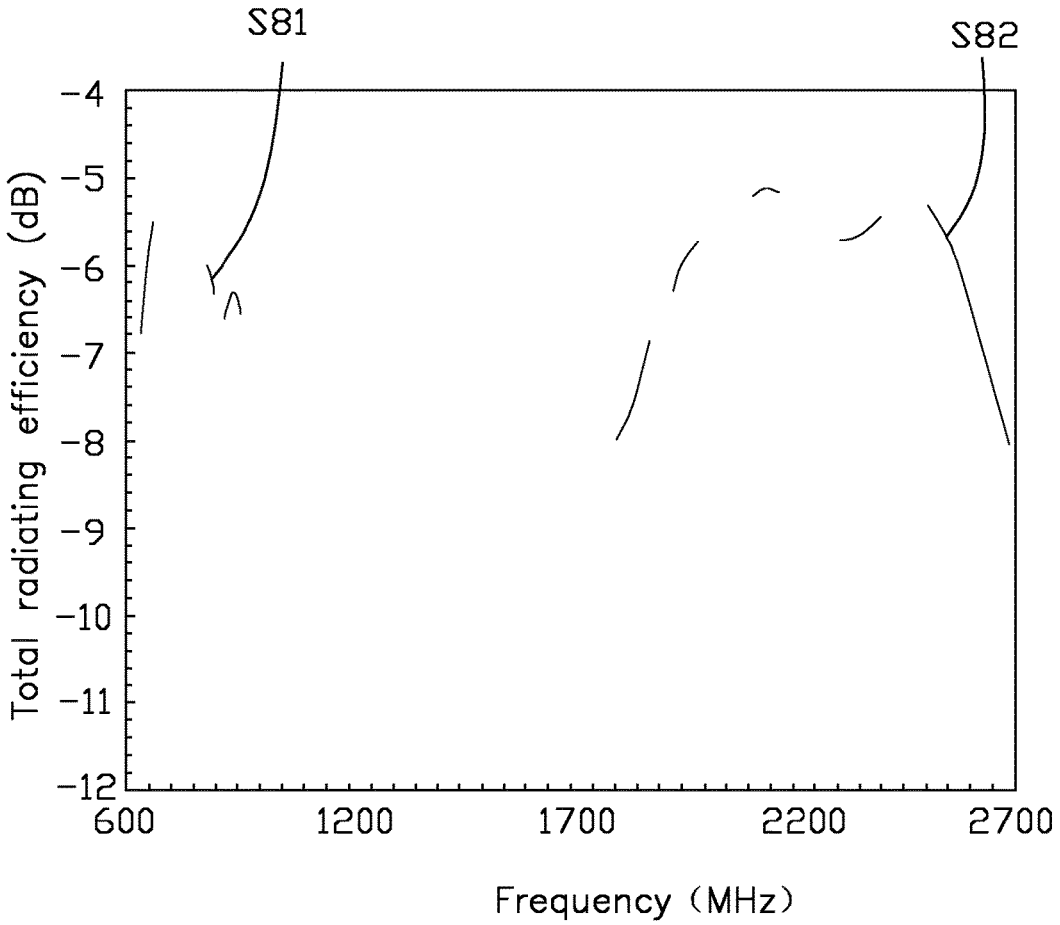
FIG. 8 is a total radiating efficiency graph of the antenna structure of FIG. 1.

FIG. 8 illustrates a total radiating efficiency graph of the antenna structure 100. Curve 81 illustrates a total radiating efficiency when the antenna structure 100 works at the low frequency band. Curve 82 illustrates a total radiating efficiency when the antenna structure 100 works at the middle and high frequency bands. When the antenna structure 100 works at these frequency bands, a working frequency satisfies a design target of the antenna and also has a good radiating efficiency.

Figure 9:
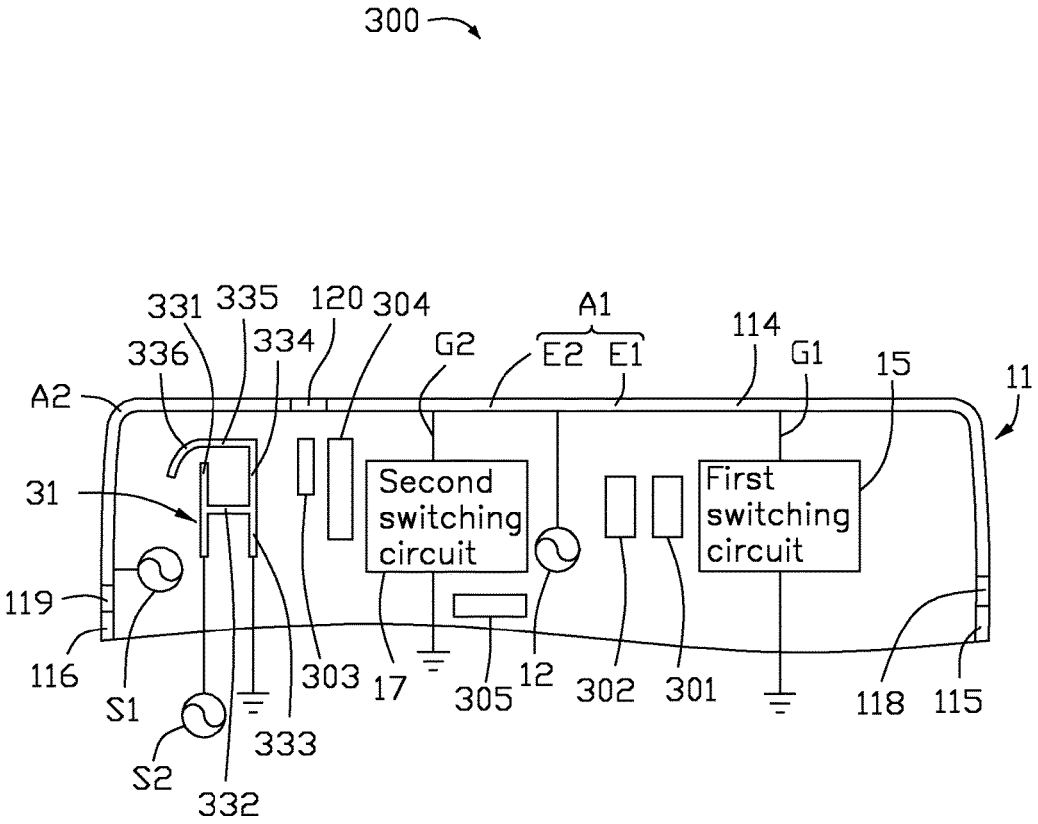
FIG. 9 is an isometric view of a second exemplary embodiment of a wireless communication device using a second exemplary antenna structure.

FIG. 9 illustrates a second exemplary antenna structure 300. The antenna structure 300 includes a housing 31, a first feed portion 12, a first ground portion G1, a second ground portion G2, a radiator 33, two second feed portions S1, S2, a first switching circuit 15, and a second switching circuit 17. The housing 31 defines a first gap 118, a second gap 119, and a groove 120. The housing 31 is divided into a first portion A1 and a second portion A2 by the slot 117, the first gap 118, the second gap 119, and the groove 120. The first feed portion 12 is electrically connected to the first portion A1 and the first portion A1 is thereby divided into a first radiating portion E1 and a second radiating portion E2. The first switching circuit 15 is electrically connected to the first radiating portion E1 through the first ground portion G1. The second switching circuit 17 is electrically connected to the second radiating portion E2 through the second ground portion G2.

In this exemplary embodiment, another antenna structure (antenna structure 300) is disclosed. Antenna structure 300 differs from the antenna structure 100 in that a structure of the radiator 33 is different from that of the radiator 13. In this exemplary embodiment, the radiator 33 includes a first radiating arm 331, a second radiating arm 332, a third radiating arm 333, a fourth radiating arm 334, a fifth radiating arm 335, and a sixth radiating arm 336. The first radiating arm 331, the second radiating arm 332, the third radiating arm 333, the fourth radiating arm 334, the fifth radiating arm 335, and the sixth radiating arm 336 are coplanar with each other.

The first radiating arm 331 is electrically connected to the second feed portion S2 and extends along a direction parallel to the second side portion 116 towards the end portion 114. The second radiating arm 332 is substantially rectangular. The second radiating arm 332 is electrically connected to the middle position of the first radiating arm 331 away from the second side portion 116 and extends along a direction parallel to the end portion 114 towards the first side portion 115.

The third radiating arm 333 is perpendicularly connected to the end of the second radiating arm 332 away from the first radiating arm 331 and extends along a direction parallel to the first radiating arm 331 away from the end portion 114, to be grounded. One end of the fourth radiating arm 334 is perpendicularly connected to a junction of the second radiating arm 332 and the third radiating arm 333. Another end of the fourth radiating arm 334 extends along a direction parallel to the first radiating arm 331 towards the end portion 114. The first radiating arm 331, the second radiating arm 332, the third radiating arm 333, and the fourth radiating arm 334 cooperatively form an H-shaped structure.

The fifth radiating arm 335 is perpendicularly connected to the end of the fourth radiating arm 334 away from the third radiating arm 333 and extends along a direction parallel to the end portion towards the second side portion 116. The sixth radiating section 336 is substantially arc-shaped. The sixth radiating arm 336 is connected to the end of the fifth radiating arm 335 away from the fourth radiating arm 334.

In other exemplary embodiment, the third radiating arm 333 of the radiator 33 can also be omitted. That is, the radiator 33 only includes the first radiating arm 331, the second radiating arm 332, the fourth radiating arm 334, the fifth radiating arm 335, and the sixth radiating arm 336. The radiator 33 forms a monopole antenna or other antenna.

In other exemplary embodiment, one end of the third radiating arm 333 is electrically connected to the second feed portion S2 and one end of the first radiating arm 331 is grounded. That is, locations of the feed source and the ground point of the radiator 33 can be exchanged.

In this exemplary embodiment, the antenna structure 300 further differs from the antenna structure 100 in that the antenna structure 300 includes five electronic elements. These are a first electronic element 301, a second electronic element 302, a third electronic element 303, a fourth electronic element 304, and a fifth electronic element 305. In this exemplary embodiment, the first electronic element 301 is a main camera module. The second electronic element 302 is an earphone interface module. The first electronic element 301 and the second electronic element 302 are positioned between the first feed portion 12 and the first ground portion G1. The first electronic element 301 and the second electronic element 302 are spaced apart from each other. The third electronic element 303 is a front camera module. The third electronic element 303 is positioned between the radiator 33 and the second ground portion G2. The third electronic element 303 is also positioned adjacent to the groove 120. The fourth electronic element 304 is a P-sensor. The fourth electronic element 304 is positioned between the third electronic element 303 and the second ground portion G2. The fifth electronic element 305 is a receiver. The fifth electronic element 305 is positioned between the second electronic element 302 and the fourth electronic element 304. The fifth electronic element 305 is also positioned adjacent to the first feed portion 12 and the second ground portion G2.

Figure 10:
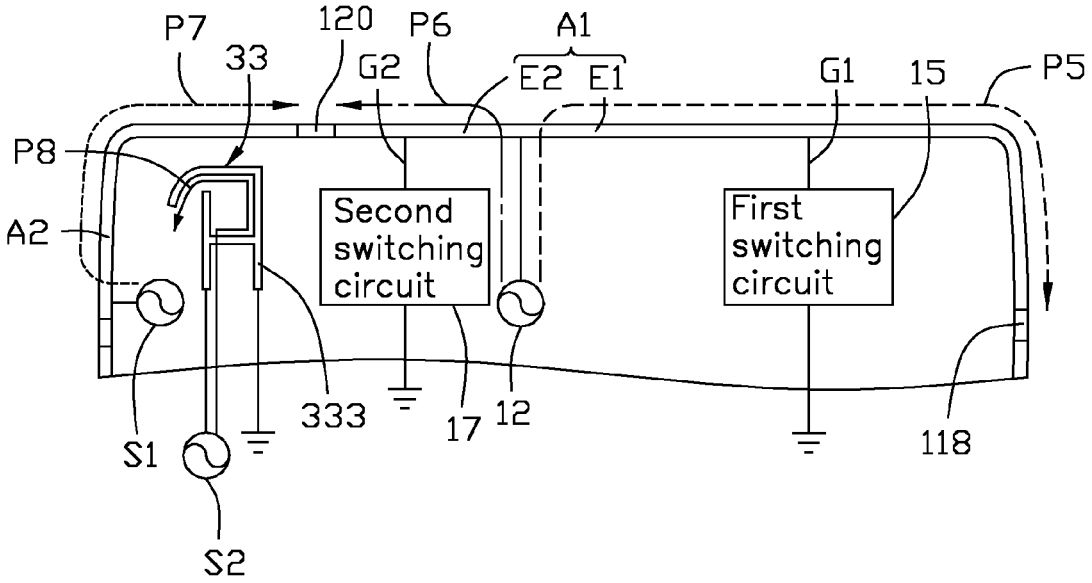
FIG. 10 is a current path distribution graph of the antenna structure of FIG. 9.

Per FIG. 10, when the first feed portion 12 supplies current, the current flows through the first radiating portion E1 and is grounded through the first ground portion G1 (Per path P5). When the first feed portion 12 supplies current, the current flows through the second radiating portion E2 and is grounded through the second ground portion G2 (Per path P6). Then, the first radiating portion E1 and the second radiating portion E2 cooperatively activate a first operation mode to generate radiation signals in a first frequency band. In this exemplary embodiment, the first operation mode is an LTE mode and includes low, middle, and high frequency operation modes. Respective frequency bands of the low, middle, and high frequency operation modes include 734-960 MHz, 1805-2170 MHz, and 2300-2690 MHz. In this exemplary embodiment, the first radiating portion E1 generates radiation signals in the low frequency band. The second radiating portion E2 generates radiation signals in the middle and high frequency bands.

When the second feed portion S1 supplies current, the current flows through the second portion A2 and is grounded through the second portion A2 (Per path P7). Then, the second portion A2 activates a second operation mode to generate radiation signals in a second frequency band, for example, GPS/GLONASS signals (1575-1602 MHz). When the second feed portion S2 supplies current, the current flows through the radiator 33 and is grounded through the third radiating arm 333 (Per path P8). Then, the radiator 33 activates a third operation mode to generate radiation signals in a third frequency band, for example, WIFI 2.4G mode and WIFI 5G mode.

Figure 11:
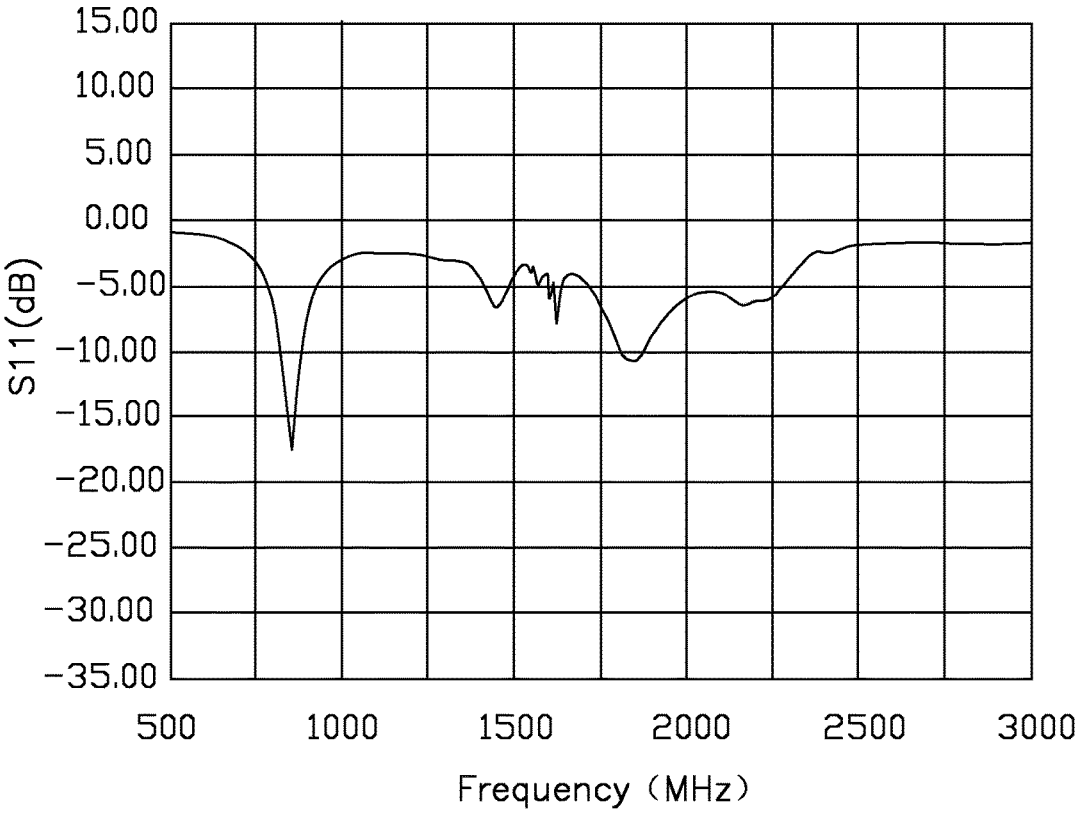
FIG. 11 is a scattering parameter graph of when the antenna structure of FIG. 9 works at low and middle frequency bands.
Figure 12:
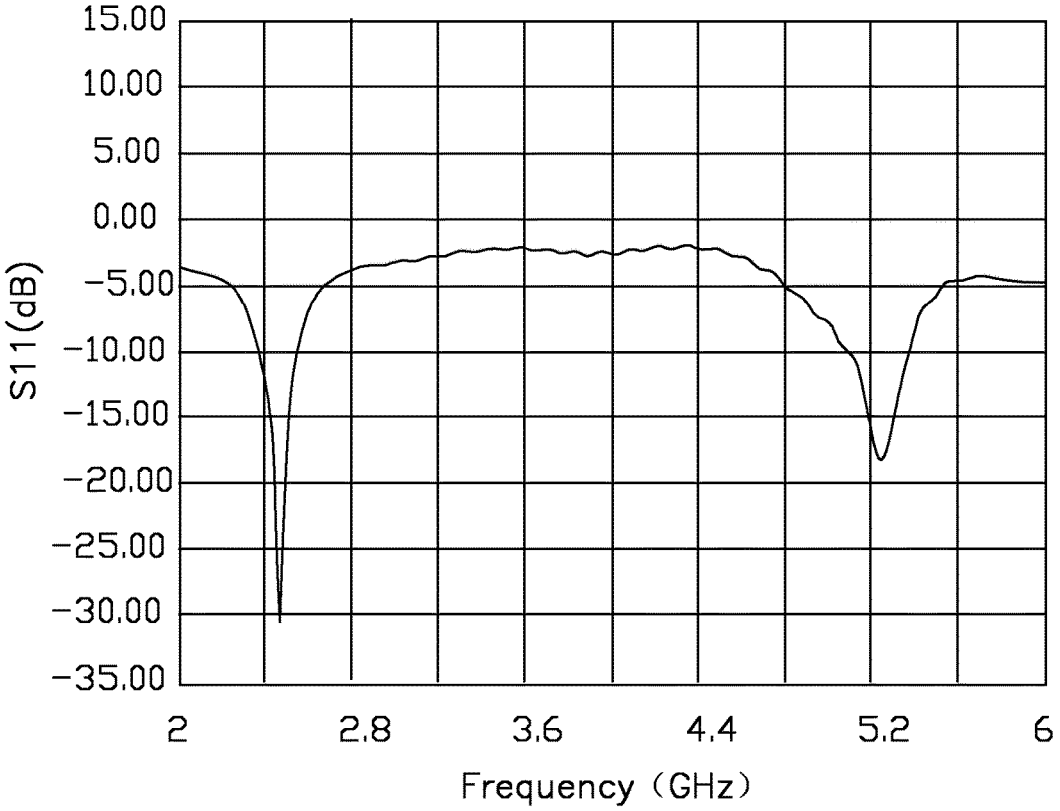
FIG. 12 is a scattering parameter graph of when the antenna structure of FIG. 9 works at a WIFI 2.4G frequency band and a WIFI 5G frequency band.
Figure 13:
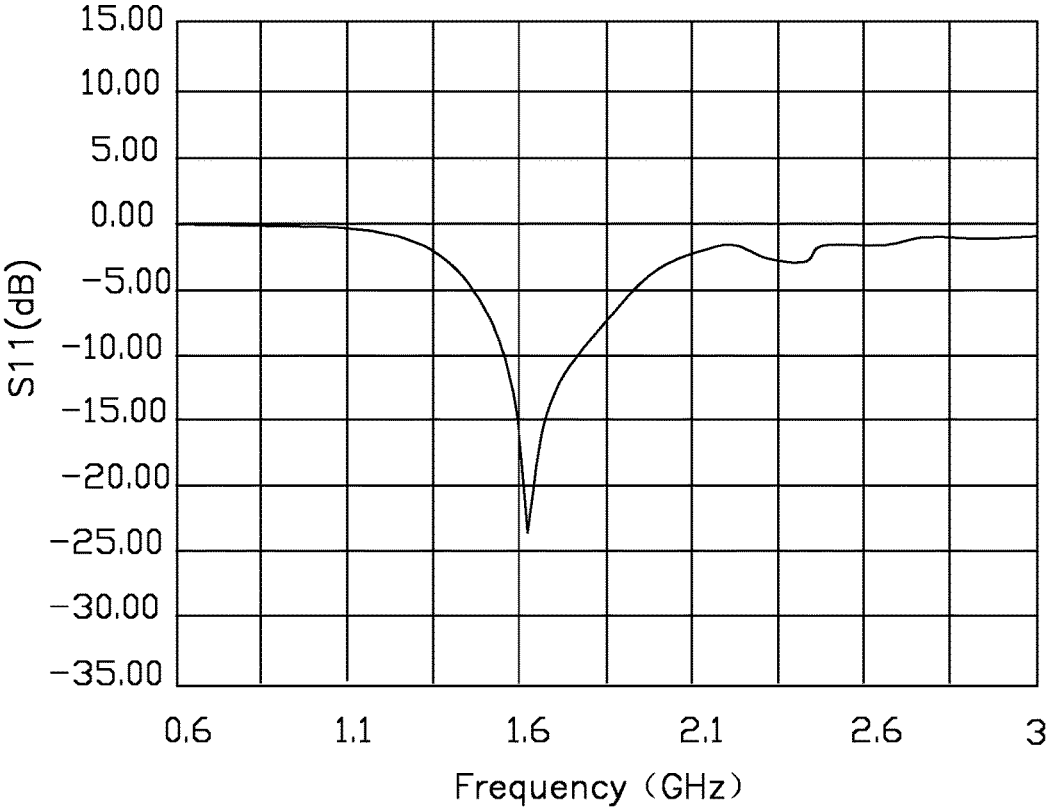
FIG. 13 is a scattering parameter graph of when the antenna structure of FIG. 9 works at a GPS/GLONASS frequency band.

FIG. 11 illustrates a scattering parameter graph of when the antenna structure 300 works at LTE low and middle frequency bands. FIG. 12 illustrates a scattering parameter graph of when the antenna structure 300 works at the WIFI 2.4G frequency band and WIFI 5G frequency band. FIG. 13 illustrates a scattering parameter graph of when the antenna structure 300 works at the GPS/GLONASS frequency band.

Figure 14:
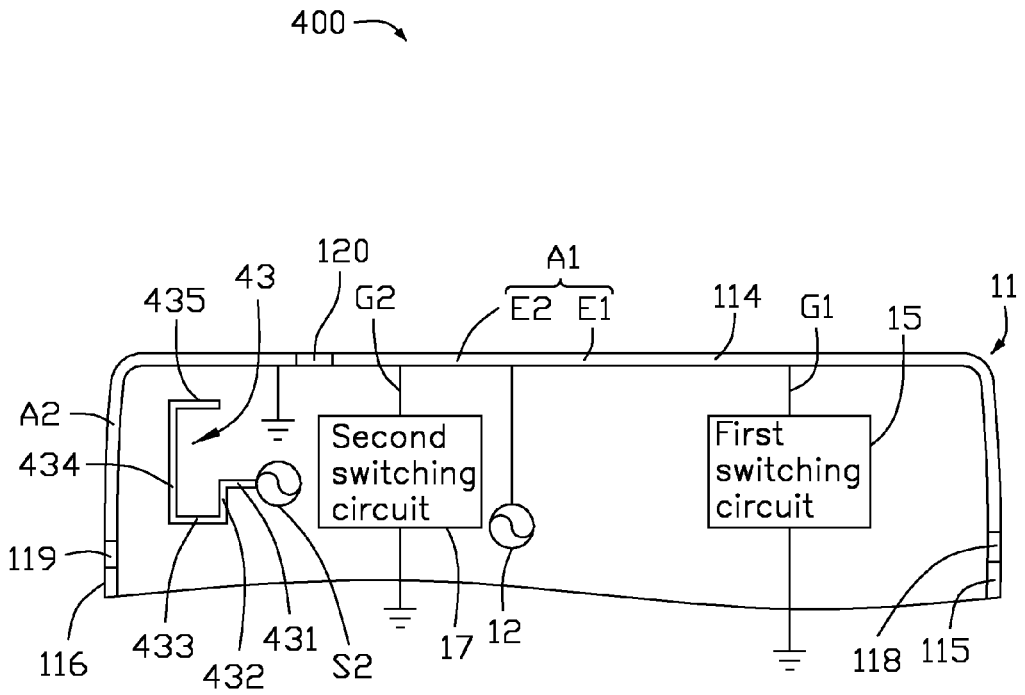
FIG. 14 is an isometric view of a third exemplary embodiment of a wireless communication device using a third exemplary antenna structure.

FIG. 14 illustrates a third exemplary antenna structure 400. The antenna structure 400 includes a housing 11, a first feed portion 12, a first ground portion G1, a second ground portion G2, a second feed portion S2, a radiator 43, a first switching circuit 15, and a second switching circuit 17. The housing 11 defines a first gap 118, a second gap 119, and a groove 120. The housing 11 is divided into a first portion A1 and a second portion A2 by the slot 117, the first gap 118, the second gap 119, and the groove 120. The first feed portion 12 is electrically connected to the first portion A1. The first portion A1 is divided into a first radiating portion E1 and a second radiating portion E2 by the first feed portion 12. The first switching circuit 15 is electrically connected to the first radiating portion E1 through the first ground portion G1. The second switching circuit 17 is electrically connected to the second radiating portion E2 through the second ground portion G2.

In this exemplary embodiment, the antenna structure 400 differs from the antenna structure 100 in that a ground location of the second portion A2 of the antenna structure 400 is different from the ground location of the second portion A2 of the antenna structure 100. The second portion A2 is grounded adjacent to the groove 120. The antenna structure 400 only includes one second feed portion S2, that is, the second feed portion S1 is omitted. A structure of the radiator 43 is different from that of the radiator 13. In other exemplary embodiments, the ground location of the second portion A2 of the antenna structure 400 can also the same as the ground location of the second portion A2 of the antenna structure 100, that is, the second portion A2 of the antenna structure 400 is grounded adjacent to the second gap 119.

In this exemplary embodiment, the radiator 43 includes a first radiating section 431, a second radiating section 432, a third radiating section 433, a fourth radiating section 434, and a fifth radiating section 435, connected in that order. The first radiating section 431 is substantially rectangular. The first radiating section 431 is electrically connected to the second feed portion S2 and extends along a direction parallel to the end portion 114 towards the second side portion 116. The second radiating section 432 is substantially rectangular. The second radiating section 432 is perpendicularly connected to the end of the first radiating section 431 away from the second feed portion S2 and extends along a direction parallel to the second side portion 116 away from the end portion 114.

The third radiating section 433 is substantially a strip. The third radiating section 433 is perpendicularly connected to the second radiating section 432 away from the first radiating section 431 and extends along a direction parallel to the end portion 114 towards the second side portion 116. The fourth radiating section 434 is substantially a strip. The fourth radiating section 434 is perpendicularly connected to the end of the third radiating section 433 away from the second radiating section 432 and extends along a direction parallel to the second side portion 116 towards the end portion 114. The fourth radiating section 434, the second radiating section 432, and the third radiating section 433 cooperatively form a U-shaped structure.

The fifth radiating section 435 is substantially rectangular. The fifth radiating section 435 is perpendicularly connected to the fourth radiating section 434 away from the third radiating section 433 and extends along a direction parallel to the end portion 114 away from the second side portion 116. The fifth radiating section 435, the third radiating section 433, and the fourth radiating section 434 cooperatively form a U-shaped structure.

Figure 15:
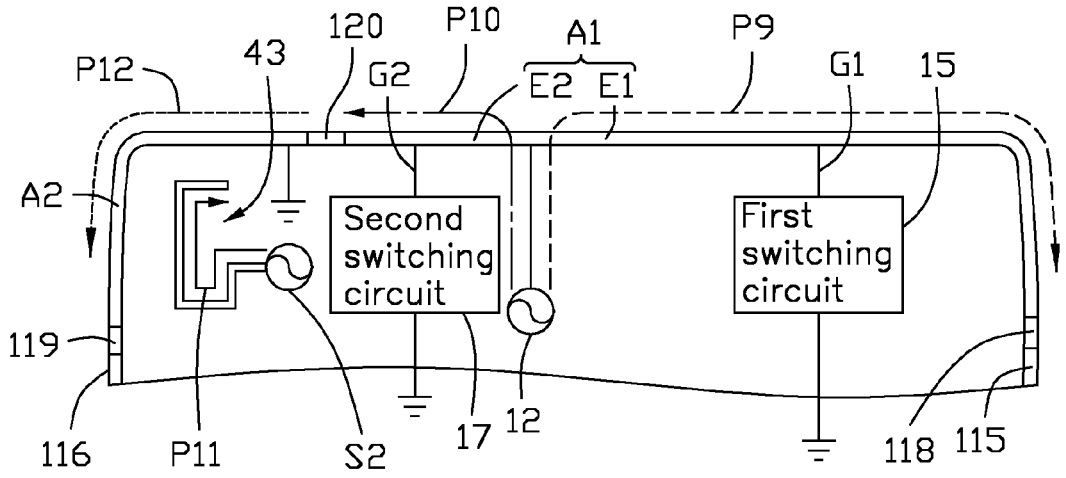
FIG. 15 is a current path distribution graph of the antenna structure of FIG. 14.

Per FIG. 15, when the first feed portion 12 supplies current, the current flows through the first radiating portion E1 and is grounded through the first ground portion G1 (Per path P9). When the first feed portion 12 supplies current, the current flows through the second radiating portion E2 and is grounded through the second ground portion G2 (Per path P10). Then, the first radiating portion E1 and the second radiating portion E2 (that is, the first portion A1) cooperatively activate a first operation mode to generate radiation signals in a first frequency band. In this exemplary embodiment, the first operation mode is an LTE mode and includes low and middle frequency operation modes. Respective frequency bands of the low and middle frequency operation modes include 734-960 MHz and 1805-2170 MHz. In this exemplary embodiment, the first radiating portion E1 generates radiation signals in the low frequency band. The second radiating portion E2 generates radiation signals in the middle frequency band.

When the second feed portion S2 supplies current, the current flows through the radiator 43 to activate a third operation mode to generate radiation signals in the third frequency band (Per path P11). In this exemplary embodiment, the third operation mode includes an LTE high frequency band of the first operation mode (2300-2690 MHz), a BLUETOOTH frequency band, and a WIFI frequency band. In addition, when the current flows through the radiator 43, the current is further coupled to the second portion A2 and is grounded (Per path P12). Then the second portion A2 activates the second operation mode to generate radiation signals in the second frequency band, for example, GPS/GLONASS signals (1575-1602 MHz).

Figure 16:
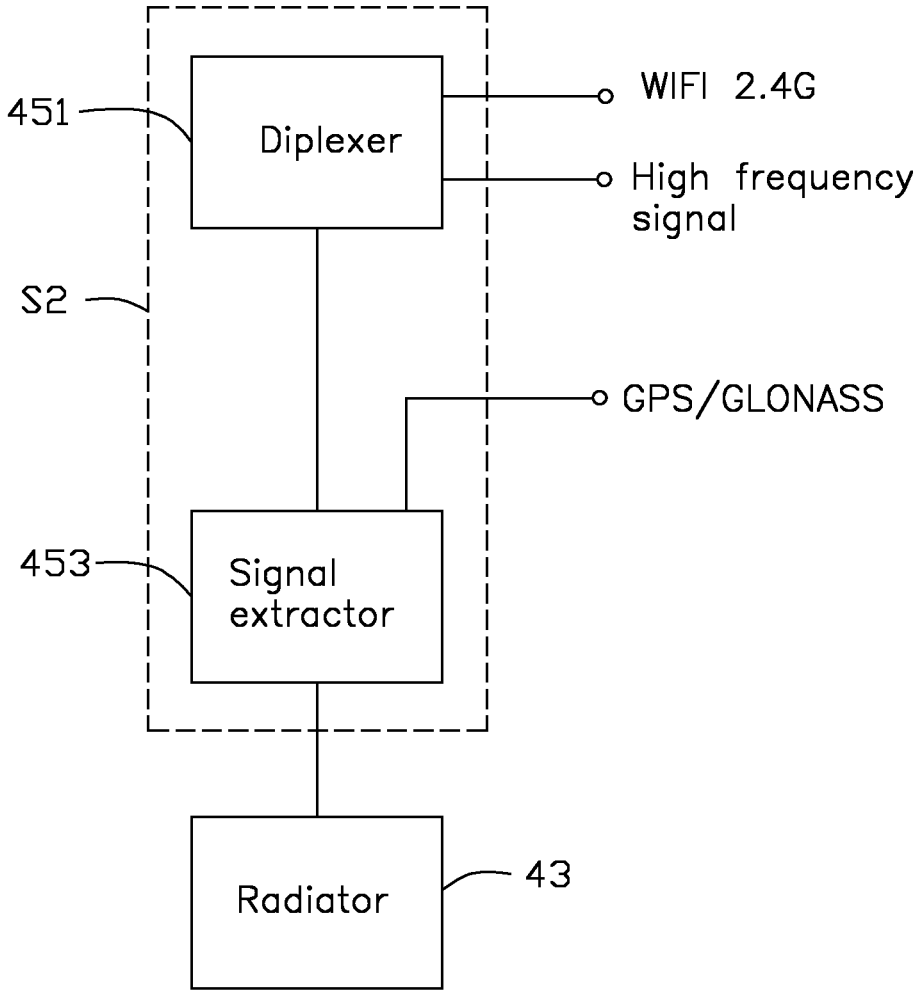
FIG. 16 is a circuit diagram of a second feed portion of the antenna structure of FIG. 14.

Per FIG. 16, in one exemplary embodiment, the second feed portion S2 includes a diplexer 451 and a signal extractor 453. Two output ends of the diplexer 451 provides the WIFI 2.4G signals and LTE high frequency band signals, sharing a signal output/input path. The signal extractor 453 provides GPS/GLONASS signals and non-GPS/GLONASS signals (for example, WIFI 2.4G signals and LTE high frequency band signals) to share a signal output/input path.

Figure 17:
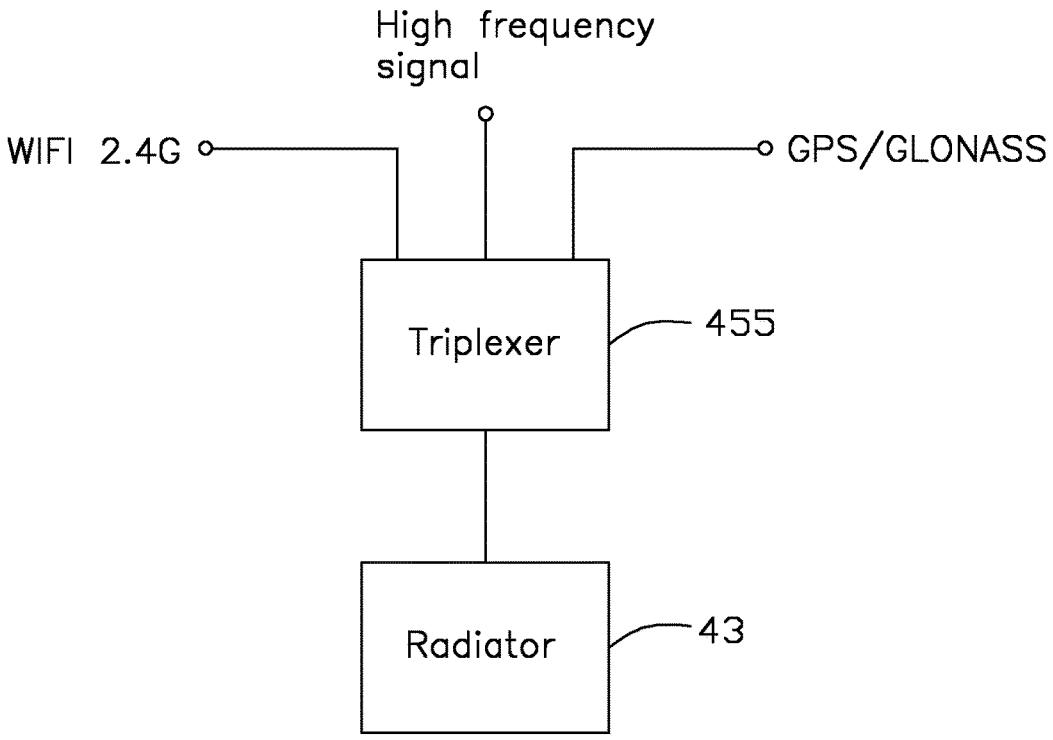
FIG. 17 is another circuit diagram of the second feed portion of the antenna structure of FIG. 14.

Per FIG. 17, in other exemplary embodiments, the second feed portion S2 only includes a triplexer 455. The triplexer 455 also provides GPS/GLONASS signals and non-GPS/GLONASS signals (for example, WIFI 2.4G signals and LTE high frequency band signals) to share a signal output/input path.

Figure 18:
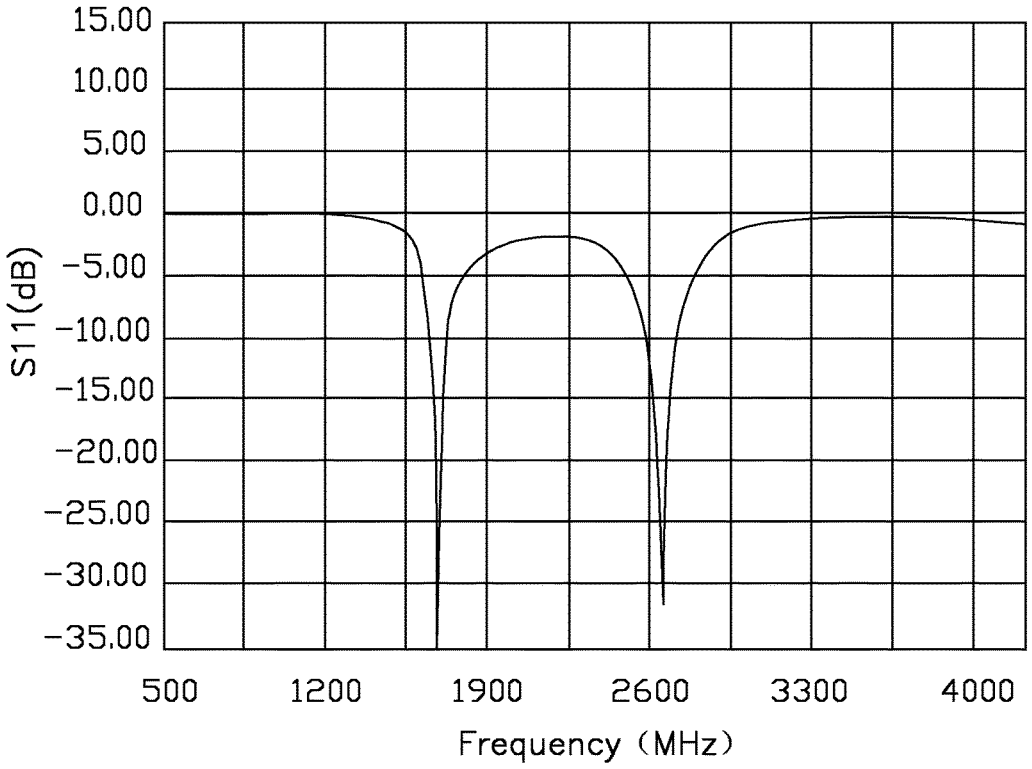
FIG. 18 is a scattering parameter graph of when the antenna structure of FIG. 14 works at a GPS/GLONASS frequency band, at a high frequency band of a first operation mode, at a BLUETOOTH frequency band, and at a WIFI frequency band.
Figure 19:
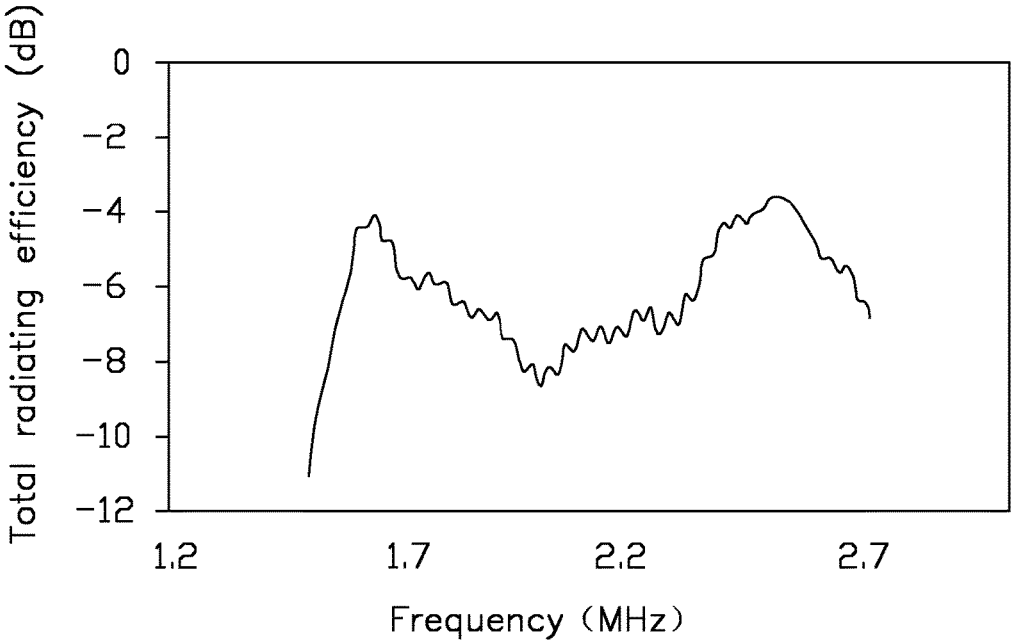
FIG. 19 is a total radiating efficiency graph of when the antenna structure of FIG. 14 works at a GPS/GLONASS frequency band, at a high frequency band of a first operation mode, at a BLUETOOTH frequency band, and at a WIFI frequency band.

FIG. 18 illustrates a scattering parameter graph of when the antenna structure 400 works at the GPS/GLONASS frequency band, the high frequency band of the first operation mode, the BLUETOOTH frequency band, and the WIFI frequency band. FIG. 19 illustrates a total radiating efficiency graph of when the antenna structure 400 works at the GPS/GLONASS frequency band, the high frequency band of the first operation mode, the BLUETOOTH frequency band, and the WIFI frequency band.

As described above, the antenna structure 100/300/400 includes the housing 11. The housing 11 is divided into the first portion A1 and the second portion A2 by the slot 117, the first gap 118, the second gap 119, and the groove 120. Then the antenna structures 100/300/400 will not be limited by a keep-out-zone and a distance from the antenna structure 100/300/400 to the ground. The antenna structures 100/300/400 can also realize wideband design and have a good radiating performance in a high frequency band.

Exemplary Embodiment 4

Figure 20:
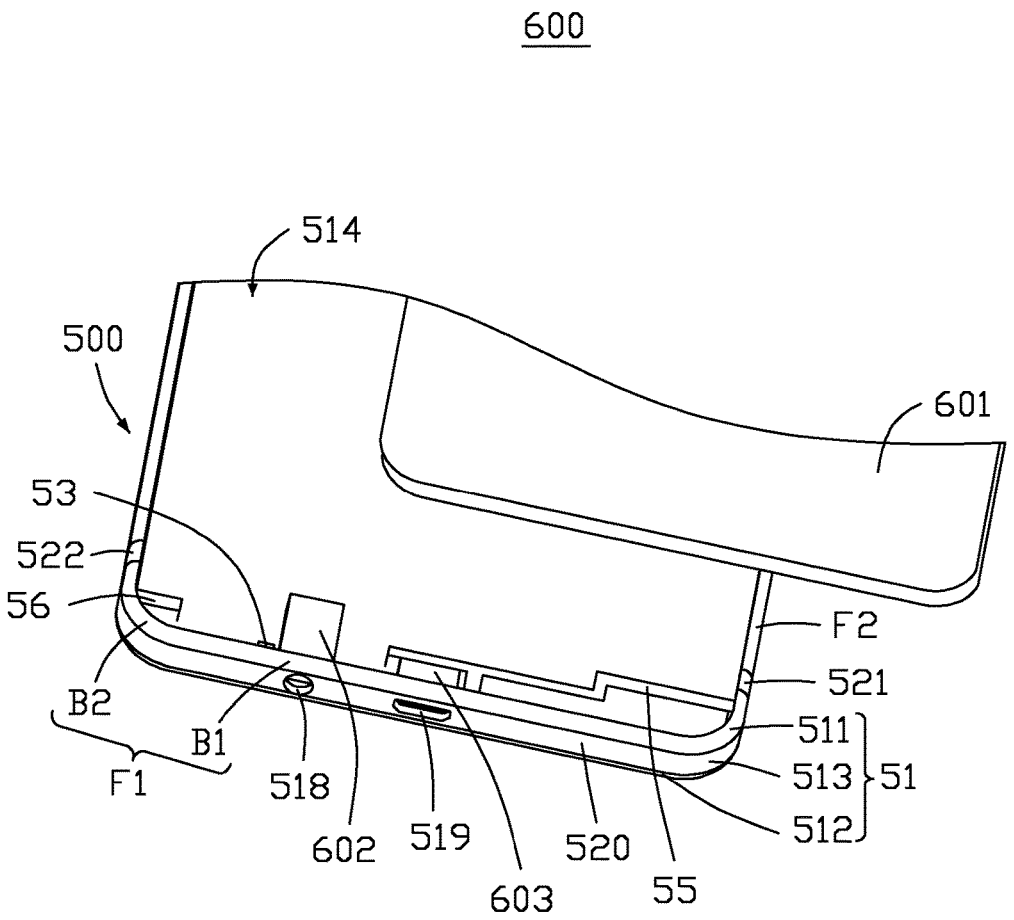
FIG. 20 is an isometric view of a fourth exemplary embodiment of a wireless communication device using a fourth exemplary antenna structure.

FIG. 20 illustrates an embodiment of a wireless communication device 600 using a fourth exemplary antenna structure 500. The wireless communication device 600 can be a mobile phone or a personal digital assistant, for example. The antenna structure 500 can receive and send wireless signals.

The antenna structure 500 includes a housing 51, a feed portion 53, a resonance portion 55, and a ground portion 56. The housing 51 can be a metal housing of the wireless communication device 600. In this exemplary embodiment, the housing 51 is made of metallic material. The housing 51 includes a front frame 511, a backboard 512, and a side frame 513. The front frame 511, the backboard 512, and the side frame 513 can be integral with each other. The front frame 511, the backboard 512, and the side frame 513 cooperatively form the metal housing of the wireless communication device 600.

The front frame 511 defines an opening (not shown). The wireless communication device 600 includes a display 601. The display 601 is received in the opening. The display 601 has a display surface. The display surface is exposed at the opening and is positioned parallel to the backboard 512.

Figure 22:
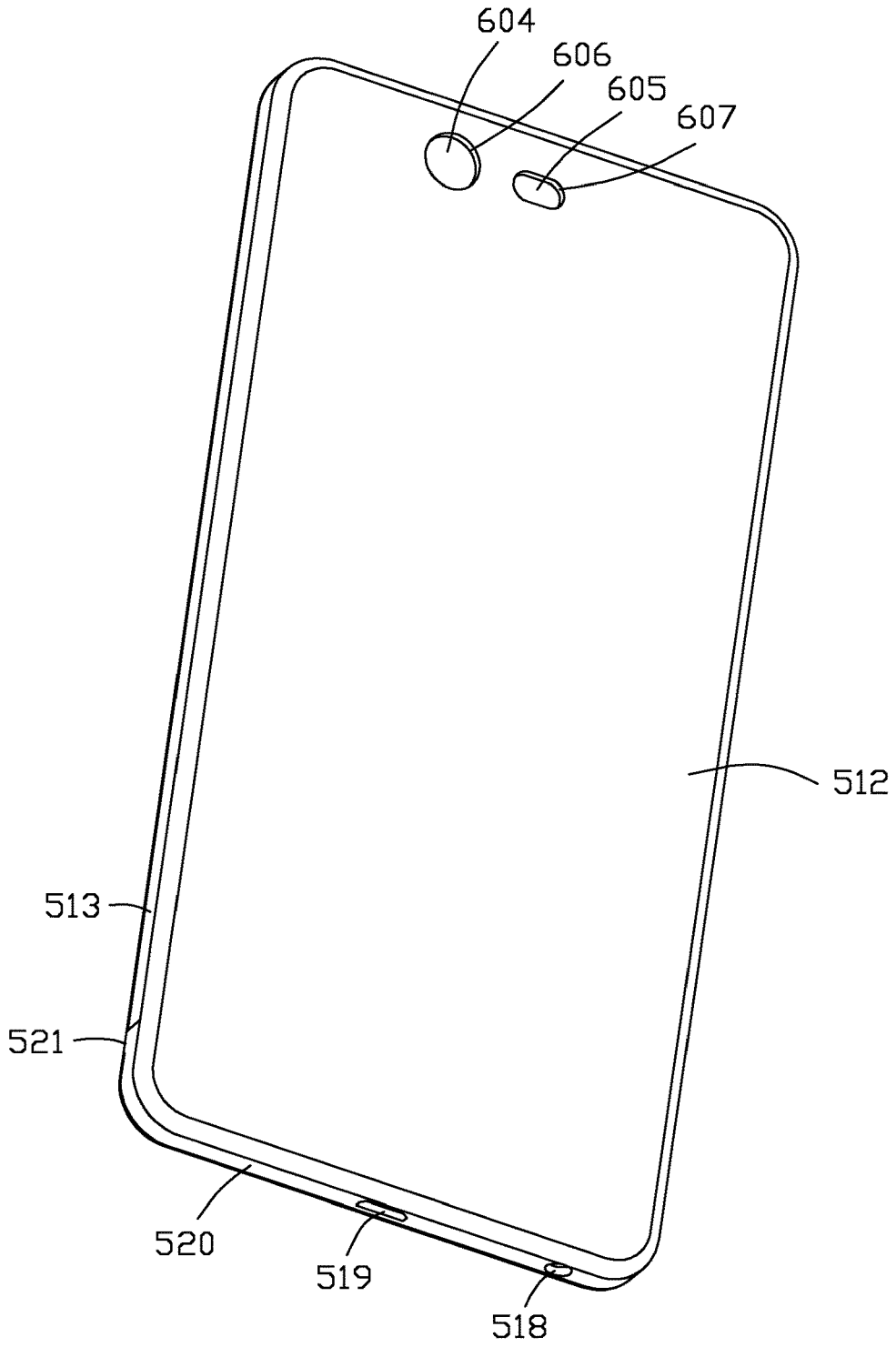
FIG. 22 is an assembled, isometric view of the wireless communication device of FIG. 20.

Per FIG. 22, the backboard 512 is positioned opposite to the front frame 511. The backboard 512 is directly connected to the side frame 513 and there is no gap between the backboard 512 and the side frame 513. The backboard 512 is an integral and single metallic sheet. Except for the holes 606 and 607 exposing a camera lens 604 and a flash light 605, the backboard 512 does not define any other slot, break line, and/or gap. The backboard 512 serves as the ground of the antenna structure 500 and the wireless communication device 600.

The side frame 513 is positioned between the front frame 511 and the backboard 512. The side frame 513 is positioned around a periphery of the front frame 511 and a periphery of the backboard 512. The side frame 513 forms a receiving space 514 together with the display 601, the front frame 511, and the backboard 512. The receiving space 514 can receive a printed circuit board, a processing unit, or other electronic components or modules.

The side frame 513 includes an end portion 515, a first side portion 516, and a second side portion 517. In this exemplary embodiment, the end portion 515 is a bottom portion of the wireless communication device 600. The end portion 515 connects the front frame 511 and the backboard 512. The first side portion 516 is positioned apart from and parallel to the second side portion 517. The end portion 515 has first and second ends. The first side portion 516 is connected to the first end of the first frame 511 and the second side portion 517 is connected to the second end of the end portion 515. The first side portion 516 connects the front frame 511 and the backboard 512. The second side portion 517 also connects the front frame 511 and the backboard 512.

The side frame 513 defines a first through hole 518, a second through hole 519, and a slot 520. The front frame 511 defines a first gap 521 and a second gap 522. In this exemplary embodiment, the first through hole 518 and the second through hole 519 are both defined on the end portion 515. The first through hole 518 and the second through hole 519 are spaced apart from each other and extend across the end portion 515.

The wireless communication device 600 includes at least one electronic element. In this exemplary embodiment, the wireless communication device 600 includes a first electronic element 602 and a second electronic element 603. In this exemplary embodiment, the first electronic element 602 is an earphone interface module. The first electronic element 602 is positioned in the receiving space 514 adjacent to the second side portion 517. The first electronic element 602 corresponds to the first through hole 518 and is partially exposed from the first through hole 518. An earphone can thus be inserted in the first through hole 518 and be electrically connected to the first electronic element 602.

The second electronic element 603 is a Universal Serial Bus (USB) module. The second electronic element 603 is positioned in the receiving space 514 and is positioned between the first electronic element 602 and the first side portion 516. The second electronic element 603 corresponds to the second through hole 519 and is partially exposed from the second through hole 519. A USB device can be inserted in the second through hole 519 and be electrically connected to the second electronic element 603.

In this exemplary embodiment, the slot 520 is defined at the end portion 515. The slot 520 communicates with the first through hole 518 and the second through hole 519. The slot 520 further extends to the first side portion 516 and the second portion 517.

The first gap 521 and the second gap 522 both communicate with the slot 520 and extend across the front frame 511. In this exemplary embodiment, the first gap 521 is defined on the front frame 511 and communicates with a first end D1 of the slot 520 positioned on the first side portion 516. The second gap 522 is defined on the front frame 511 and communicates with a second end D2 of the slot 520 positioned on the second side portion 517.

The housing 51 is divided into two portions by the slot 520, the first gap 521, and the second gap 522. The two portions are an antenna portion F1 and a ground area F2. One portion of the housing 51 surrounded by the slot 520, the first gap 521, and the second gap 522 forms the antenna portion F1. The other portions of the housing 51 forms the ground area F2. The antenna portion F1 forms an antenna structure to receive and send wireless signals. The ground area F2 is grounded.

In this exemplary embodiment, the slot 520 is defined at the end of the side frame 513 adjacent to the backboard 512 and extends to an edge of the front frame 511. Then the antenna portion F1 is fully formed by a portion of the front frame 511. In other exemplary embodiments, a position of the slot 520 can be adjusted. For example, the slot 520 can be defined on the end of the side frame 513 adjacent to the backboard 512 and extend towards the front frame 511. Then the antenna portion F1 is formed by a portion of the front frame 511 and a portion of the side frame 513.

In other exemplary embodiments, the slot 520 is only defined at the end portion 515 and does not extend to any one of the first side portion 516 and the second portion 517. In other exemplary embodiments, the slot 520 can be defined at the end portion 515 and extend to one of the first side portion 516 and the second portion 517. Then, locations of the first gap 521 and the second gap 522 can be adjusted according to a position of the slot 520. For example, the first gap 521 and the second gap 522 can both be positioned at a location of the front frame 511 corresponding to the end portion 515. For example, one of the first gap 521 and the second gap 522 can be positioned at a location of the front frame 511 corresponding to the end portion 515. The other of the first gap 521 and the second gap 522 can be positioned at a location of the front frame 511 corresponding to the first side portion 516 or the second side portion 517. That is, a shape and a location of the slot 520, locations of the first gap 521 and the second gap 522 on the side frame 512 can be adjusted, to ensure that the housing 51 can be divided into the antenna portion F1 and the ground area F2 by the slot 520, the first gap 521, and the second gap 522.

In this exemplary embodiment, except for the first through hole 518 and the second through hole 519, the slot 520, the first gap 521, and the second gap 522 are all filled with insulating material, for example, plastic, rubber, glass, wood, ceramic, or the like, thereby isolating the antenna portion F1 and the ground area F2.

In this exemplary embodiment, the feed portion 53 is positioned in the receiving space 514 and positioned at a side of the first electronic element 602 adjacent to the second side portion 517. The feed portion 53 supplies current to the antenna portion F1 and the antenna portion F1 is divided into two portions by the feed portion 53. The two portions include a first branch B1 and a second branch B2. A first portion of the front frame 511 extending from the feed portion 53 to the first gap 521 forms the first branch B1. A second portion of the front frame 511 extending from the feed portion 53 to the second gap 522 forms the second branch B2.

In this exemplary embodiment, the feed portion 53 is not positioned at the middle portion of the antenna portion F1. The first branch B1 is longer than the second branch B2. A length of the second branch B2 is equal to a quarter of a wavelength of the highest operation frequency of the second branch B2.

The resonance portion 55 is a meander sheet and is positioned in the receiving space 514. The resonance portion 55 includes a first resonance section 551, a second resonance section 553, a third resonance section 555, and a fourth resonance section 557. The first resonance section 551, the second resonance section 553, the third resonance section 555, and the fourth resonance section 557 are coplanar with each other. The first resonance section 551 is substantially rectangular. The first resonance section 551 is perpendicularly connected to the side of the first branch B1 adjacent to the first gap 521 and extends along a direction parallel to the end portion 515 towards the second side portion 517.

The second resonance section 553 is substantially rectangular. The second resonance section 553 is perpendicularly connected to the end of the first resonance section 551 away from the first gap 521 and extends along a direction parallel to the first side portion 516 towards the end portion 515. The third resonance section 555 is substantially rectangular. The third resonance section 555 is perpendicularly connected to the end of the second resonance section 553 away from the first resonance section 551 and extends along a direction parallel to the first resonance section 551 towards the second side portion 517. The third resonance section 555 passes across the second electronic element 603. The third resonance section 555 and the backboard 512 are positioned at two sides of the second electronic element 603.

The fourth resonance section 557 is positioned at a plane perpendicular to the plane of the first resonance section 551 and the plane of the backboard 512. The fourth resonance section 557 is substantially rectangular. The fourth resonance section 557 is perpendicularly connected to the end of the third resonance section 555 away from the second resonance section 553 and extends towards the backboard 512. The extension continues until the fourth resonance section 557 is electrically connected to the backboard 512 to be grounded. In this exemplary embodiment, the third resonance section 555 is longer than the first resonance section 551. The first resonance section 551 is longer than the second resonance section 553.

The ground portion 56 is positioned in the receiving space 514. One end of the ground portion 56 is electrically connected to the side of the second branch B2 adjacent to the second gap 522. Another end of the ground portion 56 is electrically connected to the backboard 512 to be grounded and grounds the second branch B2.

Figure 23:
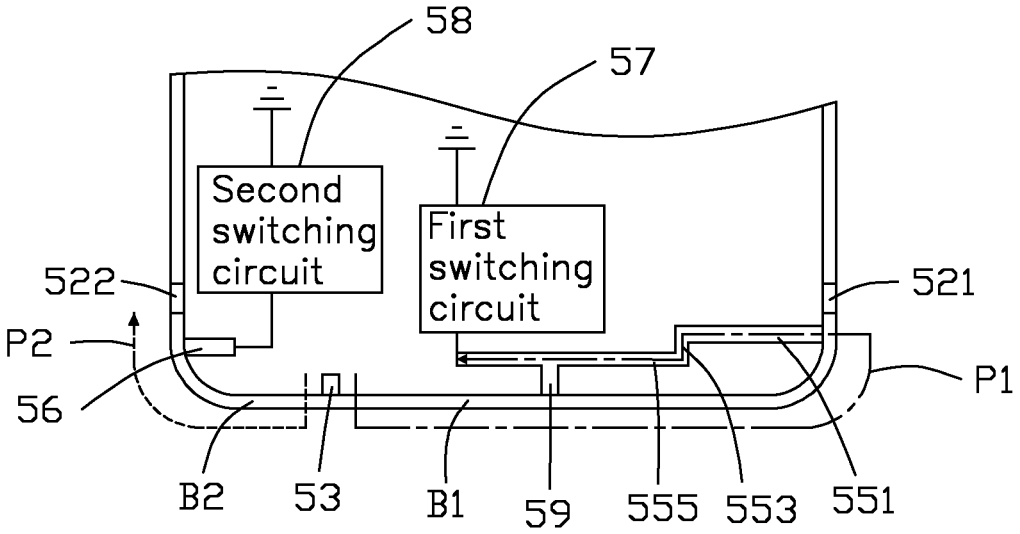
FIG. 23 is a current path distribution graph of the antenna structure of FIG. 20.

Per FIG. 23, when the feed portion 53 supplies current, the current flows through the first branch B1 of the antenna portion F1 and the resonance portion 55, and is grounded through the fourth resonance section 557 of the resonance portion 55. Then the feed portion 53, the first branch B1, and the resonance portion 55 cooperatively form a loop antenna to activate a first operation mode for generating radiation signals in a first frequency band (Per path P1). When the feed portion 53 supplies current, the current flows through the second branch B2 of the antenna portion F1 and is grounded through the ground portion 56. Then the feed portion 53, the second branch B2, and the ground portion 56 cooperatively form an inverted-F antenna to activate a second operation mode for generating radiation signals in a second frequency band (Per path P2). In this exemplary embodiment, the first operation mode is an LTE-A low frequency operation mode. The first frequency band is a frequency band of about 704-960 MHz. The second operation mode is LTE-A middle and high frequency operation modes. A frequency of the second frequency band is higher than a frequency of the first frequency band. The second frequency band includes frequency bands of about 1710-2170 MHz and 2300-2690 MHz.

In this exemplary embodiment, the antenna structure 500 further includes a first switching circuit 57. The first switching circuit 57 adjusts a bandwidth of the first frequency band, that is, the antenna structure 500 has a good bandwidth in the low frequency band. The first switching circuit 57 is positioned in the receiving space 514. One end of the first switching circuit 57 is electrically connected to the end of the fourth resonance section 557 away from the third resonance section 555. The first switching circuit 57 is electrically connected to the first branch B1 through the resonance portion 55. Another end of the first switching circuit 57 is electrically connected to the backboard 512 to be grounded.

Figure 24:
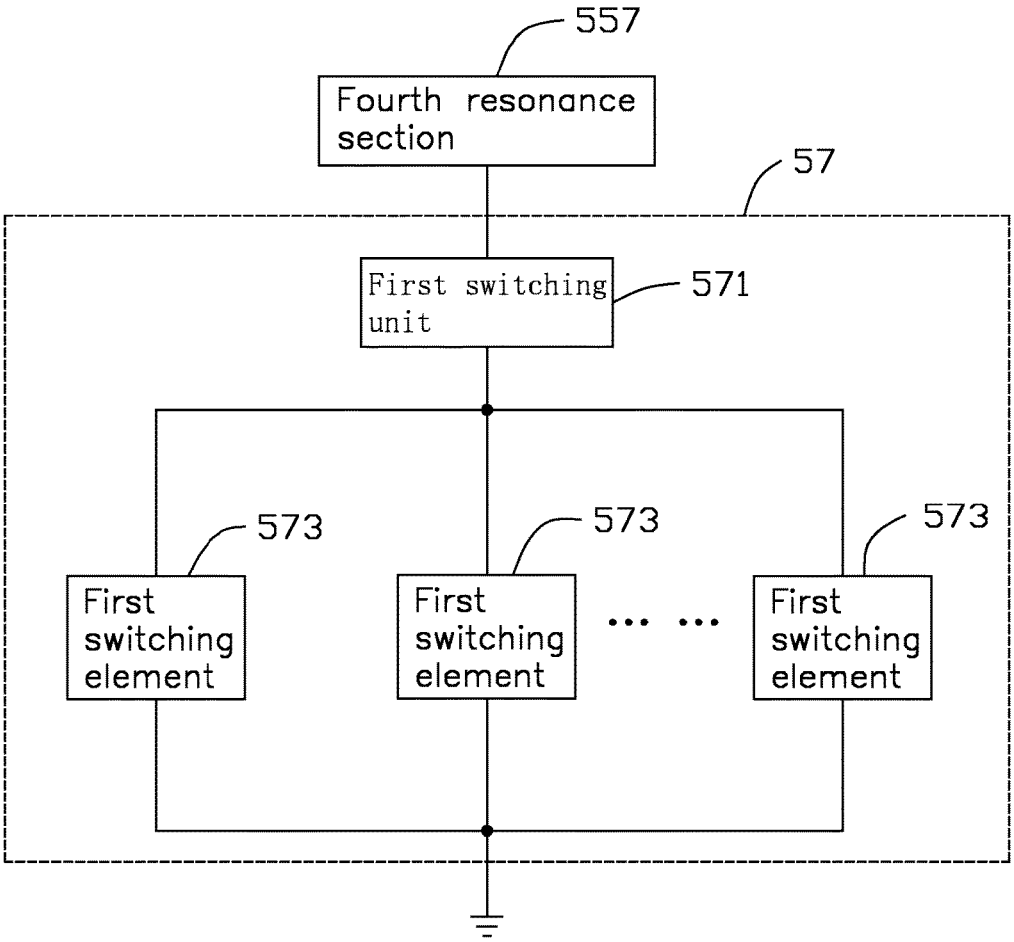
FIG. 24 is a circuit diagram of a first switching circuit of the antenna structure of FIG. 20.

Per FIG. 24, the first switching circuit 57 includes a first switching unit 571 and a plurality of first switching elements 573. The first switching unit 571 is electrically connected to the fourth resonance section 557 and then is electrically connected to the first branch B1 through the resonance portion 55. The first switching elements 573 can be an inductor, a capacitor, or a combination of the inductor and the capacitor. The first switching elements 573 are connected in parallel. One end of each first switching element 573 is electrically connected to the first switching unit 571. The other end of each first switching element 573 is electrically connected to the backboard 512.

Through control of the first switching unit 571, the fourth resonance section 557 can be switched to connect with different first switching elements 573. Since each first switching element 573 has a different impedance, a first frequency band of the first mode of the first branch B1 can be thereby adjusted.

Figure 21:
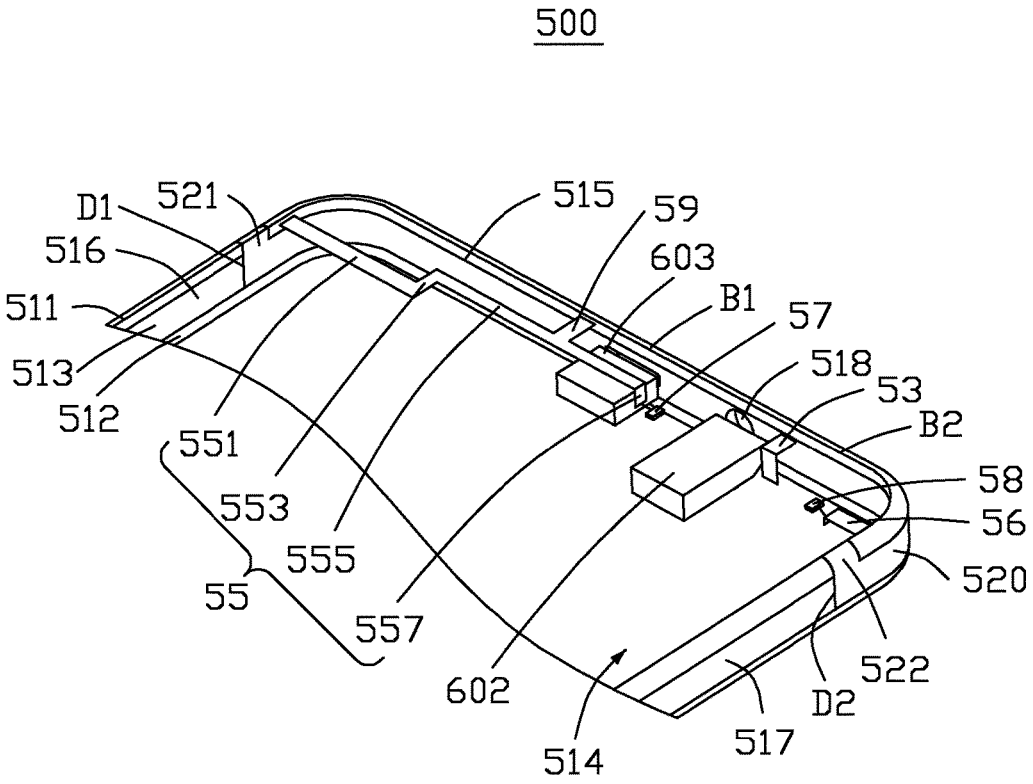
FIG. 21 is similar to FIG. 20, but shown from another angle.

Per FIG. 21 and FIG. 23, in this exemplary embodiment, the antenna structure 500 further includes a second switching circuit 58. The second switching circuit 58 adjusts a bandwidth of the middle and high frequency bands of the second branch B2.

Figure 25:
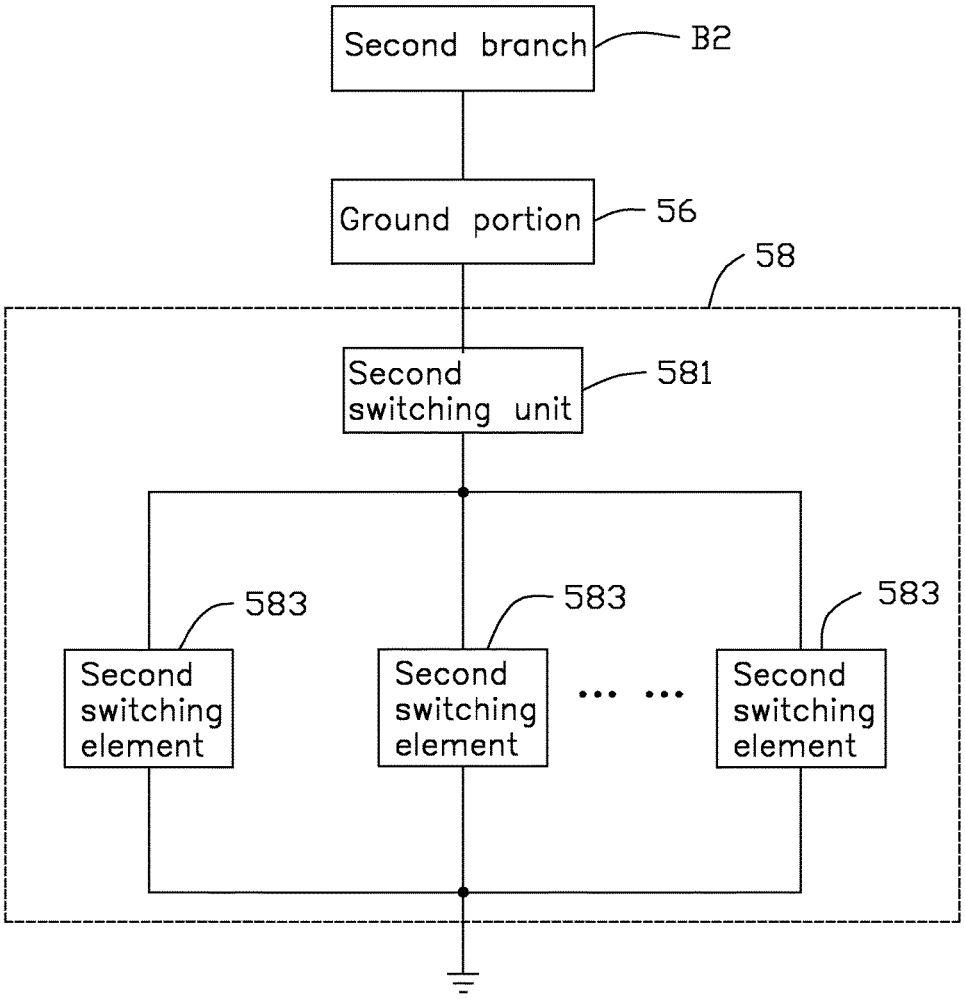
FIG. 25 is a circuit diagram of a second switching circuit of the antenna structure of FIG. 20.

Per FIG. 25, the second switching circuit 58 includes a second switching unit 581 and a plurality of second switching elements 583. The second switching unit 581 is electrically connected to the ground portion 56 and then is electrically connected to the second branch B2 through the ground portion 56. The second switching elements 583 can be an inductor, a capacitor, or a combination of the inductor and the capacitor. The second switching elements 583 are connected in parallel. One end of each second switching element 583 is electrically connected to the second switching unit 581. The other end of each second switching element 583 is electrically connected to the backboard 512.

Through the controlling of the second switching unit 581, the second branch B2 can be switched to connect with different second switching elements 583. Since each second switching elements 583 has a different impedance, a second frequency band of the second mode of the second branch B2 can be thereby adjusted.

The backboard 512 serves as a ground of the antenna structure 500 and the wireless communication device 600. In other exemplary embodiments, the wireless communication device 600 further includes a shielding mask or a middle frame (not shown). The shielding mask is positioned at the surface of the display 601 towards the backboard 512 and shields against electromagnetic interference. The middle frame is positioned at the surface of the display 601 towards the backboard 512 and supports the display 601. The shielding mask or the middle frame is made of metallic material. The shielding mask or the middle frame is electrically connected to the backboard 512 and serves as ground of the antenna structure 500 and the wireless communication device 600. For each ground point, the backboard 512 can be replaced by the shielding mask or the middle frame to ground the antenna structure 500 or the wireless communication device 600.

Per FIG. 21, in this exemplary embodiment, the antenna structure 500 further includes a connecting portion 59. The connecting portion 59 is substantially rectangular. One end of the connecting portion 59 is perpendicularly connected to the location of the first branch B1 adjacent to the second electronic element 603. Another end of the connecting portion 59 is perpendicularly connected to the third resonance section 555. A length of the first branch B1 between the feed portion 53 and the connecting portion 59 is substantially equal to a length of the second branch B2. The branch B1 between the feed portion 53 and the connecting portion 59, the connecting portion 59, and the third resonance section 555 between the connecting portion 59 and the fourth resonance section 557 cooperatively form another middle and high resonance current to improve a radiating performance of the second frequency band of the second mode.

Figure 26:
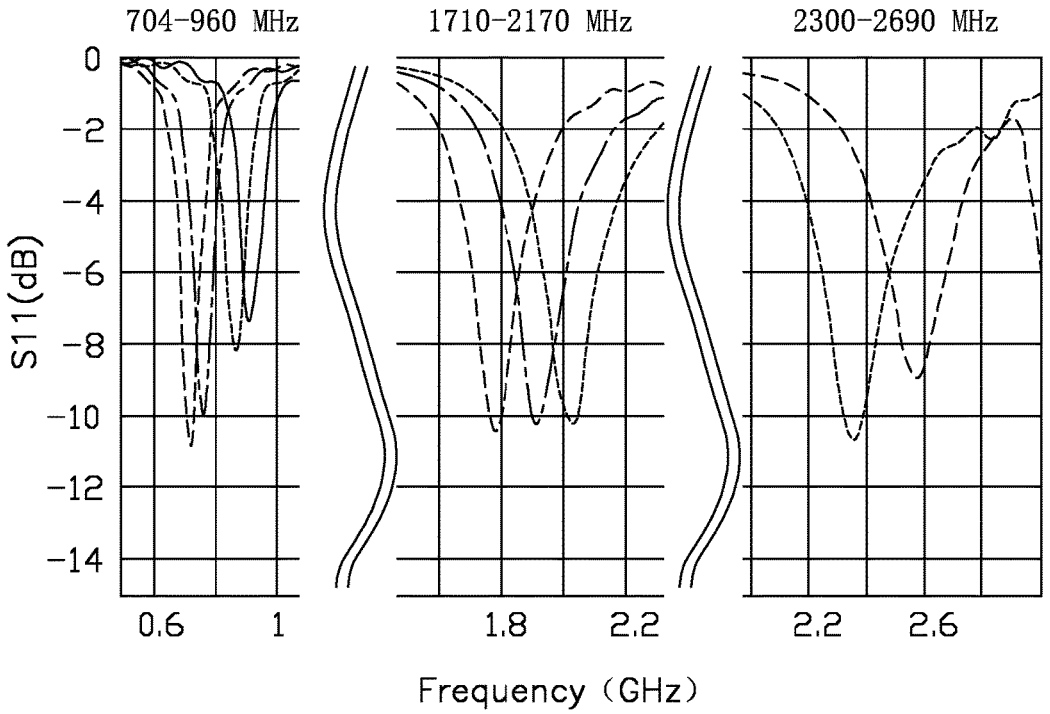
FIG. 26 is a scattering parameter graph of when the antenna structure of FIG. 20 works at low, middle, and high frequency bands.
Figure 27:
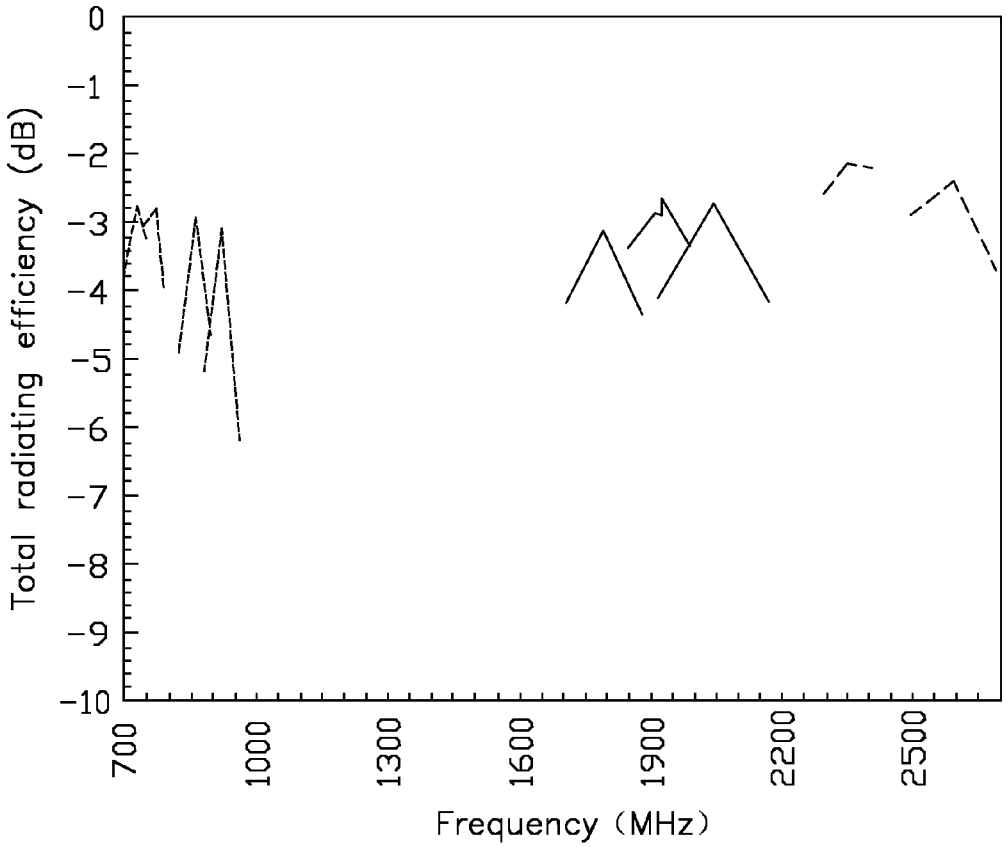
FIG. 27 is a total radiating efficiency graph of when the antenna structure of FIG. 20 works at low, middle, and high frequency bands.

FIG. 26 illustrates a scattering parameter graph of when the antenna structure 500 works at LTE low frequency operation mode (704-960 MHz), LTE middle frequency operation mode (1710-2170 MHz), and LTE high frequency operation mode (2300-2690 MHz). FIG. 27 illustrates a total radiating efficiency graph when the antenna structure 500 works at LTE low frequency operation mode (704-960 MHz), LTE middle frequency operation mode (1710-2170 MHz), and LTE high frequency operation mode (2300-2690 MHz).

As illustrated by FIGS. 26 to 27, the antenna structure 500 can work at a low frequency band (704-960 MHz). The antenna structure 500 can also work at the middle frequency band (1710-2170 MHz) and the high frequency band (2300-2690 MHz). That is, the antenna structure 500 can work at the low frequency band, the middle frequency band, and the high frequency band, and when the antenna structure 500 works at these frequency bands, a working frequency satisfies a design of the antenna and also has a good radiating efficiency.

In addition, the antenna structure 500 includes the first switching circuit 57 and the second switching circuit 58. Since each first switching element 573 and/or each second switching element 583 has a different impedance, a radiating and receiving frequency of the antenna structure 500 in the low, middle, and high frequency bands can be adjusted through the switching of the first switching unit 571 and/or of the second switching unit 581.

As described above, the antenna structure 500 defines the slot 520, the first gap 521, and the second gap 522, which divide the front frame 511 into the antenna portion F1 and the ground area F2. The antenna structure 500 further includes the feed portion 53, which divides the antenna portion F1 into the first branch B1 and the second branch B2. The antenna structure 500 further includes a resonance portion 55. The feed portion 53, the first branch B1, and the resonance portion 55 cooperatively form a loop antenna to activate a first mode for generating radiation signals in the low frequency band. The feed portion 53 and the second branch B2 cooperatively form an inverted-F antenna to activate a second mode for generating radiation signals in the middle and high frequency bands. The wireless communication device 600 can use carrier aggregation (CA) technology of LTE-A and use the first branch B1, the second branch B2, and resonance portion 55 to receive or send wireless signals at multiple frequency bands simultaneously.

In addition, the antenna structure 500 includes the housing 51. The first through hole 518, the second through hole 519, the slot 520, the first gap 521, and the second gap 522 of the housing 51 are all defined on the front frame 511 and the side frame 513 instead of on the backboard 512. Then the backboard 512 forms an all-metal structure. That is, the backboard 512 does not define any other slot and/or gap and has a good structural integrity and an aesthetic quality.

The antenna structure 100 of first exemplary embodiment, the antenna structure 300 of second exemplary embodiment, the antenna structure 400 of third exemplary embodiment, and the antenna structure 500 of fourth exemplary embodiment can be applied to one wireless communication device. For example, the antenna structures 100, 300, or 400 can be positioned at an upper end of the wireless communication device to serve as an auxiliary antenna. The antenna structure 500 can be positioned at a lower end of the wireless communication device to serve as a main antenna. When the wireless communication device sends wireless signals, the wireless communication device can use the main antenna to send wireless signals. When the wireless communication device receives wireless signals, the wireless communication device can use the main antenna and the auxiliary antenna to receive wireless signals.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a housing, the housing defining a slot, a first gap, and a groove, the slot comprising a first end and a second end, wherein the first gap is defined on the housing corresponding to the first end and communicates with the slot; the groove is defined on a portion of the housing between the first end and the second end, the groove communicates with the slot; the housing is divided into a first portion and a second portion by the first gap, the groove, and the slot; a first portion of the housing between the first gap and the groove forms the first portion; and a second portion of the housing between the gap and the second end forms the second portion;

a first feed portion, the first feed portion electrically connected to the first portion and the first portion being divided into a first radiating portion and a second radiating portion by the first feed portion; wherein a first portion of the housing extending from the first feed portion to the first gap forms the first radiating portion, and a second portion of the housing extending from the first feed portion to the groove forms the second radiating portion;

a first ground portion, the first ground portion electrically connected to the first radiating portion; and a second ground portion, the second ground portion electrically connected to the second radiating portion;

wherein the second radiating portion is shorter than the second portion, the second portion is shorter than the first radiating portion, the first portion activates a first operation mode, and the second portion activates a second operation mode.

2. The antenna structure of claim 1, wherein the slot, the first gap, and the groove are all filled with insulating material.

3. The antenna structure of claim 1, wherein the housing at least comprises a front frame and a side frame, the front frame is positioned around a periphery of the side frame, the slot is defined on the side frame, and the first gap and the groove are defined on the front frame.

4. The antenna structure of claim 1, wherein the housing further defines a second gap, the second gap is defined on the housing corresponding to the second end and communicates with the slot, a portion of the housing between the groove and the second gap forms the second portion.

5. The antenna structure of claim 1, further comprising a radiator and two second feed portions, wherein one of the two second feed portions is electrically connected to the second portion, the other of the two second feed portions is electrically connected to the radiator, and the second portion is grounded.

6. The antenna structure of claim 5, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when one of the two the second feed portions supplies current, the current flows through the second portion and is grounded through the second portion, the second portion activates the second operation mode to generate radiation signals in a second frequency band; when the other of the two the second feed portions supplies current, the current flows through the radiator, and the radiator activates a third operation mode to generate radiation signals in a third frequency band.

7. The antenna structure of claim 6, wherein the first operation mode is a LTE mode, the second operation mode is a GPS/GLONASS mode, and the third operation mode is a WIFI mode.

8. The antenna structure of claim 5, wherein the radiator comprises a connecting portion, a first branch, and a second branch, the connecting portion comprises a first connecting section and a second connecting section, the first connecting section is electrically connected to one of two second feed portions to feed current to the radiator; the second connecting section is perpendicularly connected to an end of the first connecting section to form a L-shaped structure with the first connecting section; the first branch comprises a first extending section, a second extending section, and a third extending section, the first extending section is connected to the end of the second connecting section away from the first connecting section and extends along a direction perpendicular and away from the first connecting section to be collinear with the second connecting section; one end of the second extending section is perpendicularly connected to the end of the first extending section away from the second connecting section, another end of the second extending section extends along a direction parallel to the first connecting section away from the first extending section; one end of the third extending section is electrically connected to the end of the second extending section away from the first extending section, another end of the third extending section extends along a direction parallel to the second connecting section towards the first connecting section; the second branch comprises a first resonance section and a second resonance section; one end of the first resonance section is perpendicularly connected to a junction of the second connecting section and the first extending section, another end of the first resonance section extends along a direction parallel to the first connecting section; one end of the second resonance section is perpendicularly connected to the end of the first resonance section away from the second connecting section and the first extending section, another end of the second resonance section extends along a direction perpendicular to the first resonance section towards the second extending section to form the L-shaped structure with the first resonance section.

9. The antenna structure of claim 5, further comprising a third ground portion, wherein the radiator comprises a first radiating arm, a second radiating arm, a third radiating arm, a fourth radiating arm, a fifth radiating arm, and a sixth radiating arm; the second radiating arm is perpendicularly connected to a middle position of the first radiating arm, the third radiating arm is perpendicularly connected to the end of the second radiating arm away from the first radiating arm and extends along a direction parallel to the first radiating arm; one end of the fourth radiating arm is perpendicularly connected to a junction of the second radiating arm and the third radiating arm, another end of the fourth radiating arm extends along a direction parallel to the first radiating arm away from the third radiating arm to form a H-shaped structure with the first radiating arm, the second radiating arm, and the third radiating arm; the fifth radiating arm is perpendicularly connected to the end of the fourth radiating arm away from the third radiating arm and extends along a direction parallel to the second radiating arm; the sixth radiating section is substantially arc-shaped, the sixth radiating arm is connected to the end of the fifth radiating arm away from the fourth radiating arm; one of the first radiating arm and the third radiating arm is electrically connected to one of the two second feed portions, and the other of the first radiating arm and the third radiating arm is electrically connected to the third ground portion.

10. The antenna structure of claim 5, wherein the radiator comprises a first radiating arm, a second radiating arm, a fourth radiating arm, a fifth radiating arm, and a sixth radiating arm; the first radiating arm is electrically connected to one of two second feed portions, the second radiating arm is perpendicularly connected to a middle position of the first radiating arm, one end of the fourth radiating arm is perpendicularly connected to the end of the second radiating arm away from the first radiating arm, another end of the fourth radiating arm extends along a direction parallel to the first radiating arm; the fifth radiating arm is perpendicularly connected to the end of the fourth radiating arm away from the second radiating arm and extends along a direction parallel to the second radiating arm; the sixth radiating section is substantially arc-shaped, the sixth radiating arm is connected to the end of the fifth radiating arm away from the fourth radiating arm.

11. The antenna structure of claim 1, further comprising a first switching circuit, wherein the first switching circuit comprises a first switching unit and a plurality of first switching elements, the first switching unit is electrically connected to the first ground portion, the first switching elements are connected in parallel to each other, one end of each first switching element is electrically connected to the first switching unit, and the other end of each first switching element is grounded; through controlling the first switching unit to switch, the first radiating portion is switched to different first switching elements and a frequency band of the first radiating portion is adjusted.

12. The antenna structure of claim 1, further comprising a second switching circuit, wherein the second switching circuit comprises a second switching unit and a plurality of second switching elements, the second switching unit is electrically connected to the second ground portion, the second switching elements are connected in parallel to each other, one end of each second switching element is electrically connected to the second switching unit, and the other end of each second switching element is grounded; through controlling the second switching unit to switch, the second radiating portion is switched to different second switching elements and a frequency band of the second radiating portion is adjusted.

13. The antenna structure of claim 1, wherein a wireless communication device uses the first portion to receive or send wireless signals at multiple frequency bands simultaneously through carrier aggregation (CA) technology of Long Term Evolution Advanced (LTE-A).

14. The antenna structure of claim 1, further comprising a radiator and a second feed portion, wherein the second feed portion is electrically connected to the radiator, and the second portion is grounded.

15. The antenna structure of claim 14, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when the second feed portions supplies current, the current flows through the radiator and is coupled to the second portion, the second portion activates the second operation mode to generate radiation signals in a second frequency band; when the current flows through the radiator, the radiator further activates a third operation mode to generate radiation signals in a third frequency band.

16. The antenna structure of claim 15, wherein the first operation mode is a LTE mode, the second operation mode is a GPS/GLONASS mode, and the third frequency band comprises a high frequency band of the first operation mode, a Bluetooth frequency band, and a WIFI frequency band.

17. The antenna structure of claim 14, wherein the radiator comprises a first radiating section, a second radiating section, a third radiating section, a fourth radiating section, and a fifth radiating section connected in that order; the first radiating section is electrically connected to the second feed portion; the second radiating section is perpendicularly connected to the end of the first radiating section away from the second feed portion; the third radiating section is perpendicularly connected to the end of the second radiating section away from the first radiating section; the fourth radiating section is perpendicularly connected to the end of the third radiating section away from the second radiating section and extends along a direction parallel to the second side portion to form a U-shaped structure with the second radiating section and the third radiating section; the fifth radiating section is perpendicularly connected to the fourth radiating section away from the third radiating section and extends along a direction parallel to the third radiating section towards the second radiating section to form a U-shaped structure with the third radiating section and the fourth radiating section.

18. The antenna structure of claim 17, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when the second feed portions supplies current, the current flows through the radiator and is coupled to the second portion, the second portion activates the second operation mode to generate radiation signals in a second frequency band; when the current flows through the radiator, the radiator further activates a third operation mode to generate radiation signals in a third frequency band.

19. The antenna structure of claim 18, wherein the first operation mode is a LTE mode, the second operation mode is a GPS/GLONASS mode, and the third frequency band comprises a high frequency band of the first operation mode, a Bluetooth frequency band, and a WIFI frequency band.

20. The antenna structure of claim 19, wherein the second feed portion comprises a diplexer and a signal extractor, two output ends of the diplexer provides the WIFI 2.4G signals and LTE high frequency band signals to share a signal output/input path; the signal extractor provides GPS/GLONASS signals and non GPS/GLONASS signals to share a signal output/input path.

21. The antenna structure of claim 19, wherein the second feed portion comprises a triplexer, the triplexer provides GPS/GLONASS signals and non GPS/GLONASS signals to share a signal output/input path.

22. A wireless communication device comprising:

an antenna structure, the antenna structure comprising:

a housing, the housing defining a slot, a first gap, and a groove, the slot comprising a first end and a second end, wherein the first gap is defined on the housing corresponding to the first end and communicates with the slot; the groove is defined on a portion of the housing between the first end and the second end, the groove communicates with the slot; the housing is divided into a first portion and a second portion by the first gap, the groove, and the slot; a first portion of the housing between the first gap and the groove forms the first portion; and a second portion of the housing between the gap and the second end forms the second portion;

a first feed portion, the first feed portion electrically connected to the first portion and the first portion being divided into a first radiating portion and a second radiating portion by the first feed portion; wherein a first portion of the housing extending from the first feed portion to the first gap forms the first radiating portion, and a second portion of the housing extending from the first feed portion to the groove forms the second radiating portion;

a first ground portion, the first ground portion electrically connected to the first radiating portion; and a second ground portion, the second ground portion electrically connected to the second radiating portion;

wherein the second radiating portion is shorter than the second portion, the second portion is shorter than the first radiating portion, the first portion activates a first operation mode, and the second portion activates a second operation mode.

23. The wireless communication device of claim 22, wherein the slot, the first gap, and the groove are all filled with insulating material.

24. The wireless communication device of claim 22, wherein the housing at least comprises a front frame and a side frame, the front frame is positioned around a periphery of the side frame, the slot is defined on the side frame, and the first gap and the groove are defined on the front frame.

25. The wireless communication device of claim 22, wherein the housing further defines a second gap, the second gap is defined on the housing corresponding to the second end and communicates with the slot, a portion of the housing between the groove and the second gap forms the second portion.

26. The wireless communication device of claim 22, wherein the antenna structure further comprises a radiator and two second feed portions, one of the two second feed portions is electrically connected to the second portion, the other of the two second feed portions is electrically connected to the radiator, and the second portion is grounded.

27. The wireless communication device of claim 26, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when one of the two the second feed portions supplies current, the current flows through the second portion and is grounded through the second portion, the second portion activates the second operation mode to generate radiation signals in a second frequency band; when the other of the two the second feed portions supplies current, the current flows through the radiator, and the radiator activates a third operation mode to generate radiation signals in a third frequency band.

28. The wireless communication device of claim 27, wherein the first operation mode is a LTE mode, the second operation mode is a GPS/GLONASS mode, and the third operation mode is a WIFI mode.

29. The wireless communication device of claim 26, wherein the radiator comprises a connecting portion, a first branch, and a second branch, the connecting portion comprises a first connecting section and a second connecting section, the first connecting section is electrically connected to one of two second feed portions to feed current to the radiator; the second connecting section is perpendicularly connected to an end of the first connecting section to form a L-shaped structure with the first connecting section; the first branch comprises a first extending section, a second extending section, and a third extending section, the first extending section is connected to the end of the second connecting section away from the first connecting section and extends along a direction perpendicular and away from the first connecting section to be collinear with the second connecting section; one end of the second extending section is perpendicularly connected to the end of the first extending section away from the second connecting section, another end of the second extending section extends along a direction parallel to the first connecting section away from the first extending section; one end of the third extending section is electrically connected to the end of the second extending section away from the first extending section, another end of the third extending section extends along a direction parallel to the second connecting section towards the first connecting section; the second branch comprises a first resonance section and a second resonance section; one end of the first resonance section is perpendicularly connected to a junction of the second connecting section and the first extending section, another end of the first resonance section extends along a direction parallel to the first connecting section; one end of the second resonance section is perpendicularly connected to the end of the first resonance section away from the second connecting section and the first extending section, another end of the second resonance section extends along a direction perpendicular to the first resonance section towards the second extending section to form the L-shaped structure with the first resonance section.

30. The wireless communication device of claim 26, wherein the antenna structure further comprises a third ground portion, the radiator comprises a first radiating arm, a second radiating arm, a third radiating arm, a fourth radiating arm, a fifth radiating arm, and a sixth radiating arm; the second radiating arm is perpendicularly connected to a middle position of the first radiating arm, the third radiating arm is perpendicularly connected to the end of the second radiating arm away from the first radiating arm and extends along a direction parallel to the first radiating arm; one end of the fourth radiating arm is perpendicularly connected to a junction of the second radiating arm and the third radiating arm, another end of the fourth radiating arm extends along a direction parallel to the first radiating arm away from the third radiating arm to form a H-shaped structure with the first radiating arm, the second radiating arm, and the third radiating arm; the fifth radiating arm is perpendicularly connected to the end of the fourth radiating arm away from the third radiating arm and extends along a direction parallel to the second radiating arm; the sixth radiating section is substantially arc-shaped, the sixth radiating arm is connected to the end of the fifth radiating arm away from the fourth radiating arm; one of the first radiating arm and the third radiating arm is electrically connected to one of the two second feed portions, and the other of the first radiating arm and the third radiating arm is electrically connected to the third ground portion.

31. The wireless communication device of claim 26, wherein the radiator comprises a first radiating arm, a second radiating arm, a fourth radiating arm, a fifth radiating arm, and a sixth radiating arm; the first radiating arm is electrically connected to one of two second feed portions, the second radiating arm is perpendicularly connected to a middle position of the first radiating arm, one end of the fourth radiating arm is perpendicularly connected to the end of the second radiating arm away from the first radiating arm, another end of the fourth radiating arm extends along a direction parallel to the first radiating arm; the fifth radiating arm is perpendicularly connected to the end of the fourth radiating arm away from the second radiating arm and extends along a direction parallel to the second radiating arm; the sixth radiating section is substantially arc-shaped, the sixth radiating arm is connected to the end of the fifth radiating arm away from the fourth radiating arm.

32. The wireless communication device of claim 22, wherein the antenna structure further comprises a first switching circuit, the first switching circuit comprises a first switching unit and a plurality of first switching elements, the first switching unit is electrically connected to the first ground portion, the first switching elements are connected in parallel to each other, one end of each first switching element is electrically connected to the first switching unit, and the other end of each first switching element is grounded; through controlling the first switching unit to switch, the first radiating portion is switched to different first switching elements and a frequency band of the first radiating portion is adjusted.

33. The wireless communication device of claim 22, wherein the antenna structure further comprises a second switching circuit, the second switching circuit comprises a second switching unit and a plurality of second switching elements, the second switching unit is electrically connected to the second ground portion, the second switching elements are connected in parallel to each other, one end of each second switching element is electrically connected to the second switching unit, and the other end of each second switching element is grounded; through controlling the second switching unit to switch, the second radiating portion is switched to different second switching elements and a frequency band of the second radiating portion is adjusted.

34. The wireless communication device of claim 22, wherein the wireless communication device uses the first portion to receive or send wireless signals at multiple frequency bands simultaneously through carrier aggregation (CA) technology of Long Term Evolution Advanced (LTE-A).

35. The wireless communication device of claim 22, wherein the antenna structure further comprises a radiator and a second feed portion, the second feed portion is electrically connected to the radiator, and the second portion is grounded.

36. The wireless communication device of claim 35, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when the second feed portions supplies current, the current flows through the radiator and is coupled to the second portion, the second portion activates the second operation mode to generate radiation signals in a second frequency band; when the current flows through the radiator, the radiator further activates a third operation mode to generate radiation signals in a third frequency band.

37. The wireless communication device of claim 36, wherein the first operation mode is a LTE mode, the second operation mode is a GPS/GLONASS mode, and the third frequency band comprises a high frequency band of the first operation mode, a Bluetooth frequency band, and a WIFI frequency band.

38. The wireless communication device of claim 35, wherein the radiator comprises a first radiating section, a second radiating section, a third radiating section, a fourth radiating section, and a fifth radiating section connected in that order; the first radiating section is electrically connected to the second feed portion; the second radiating section is perpendicularly connected to the end of the first radiating section away from the second feed portion; the third radiating section is perpendicularly connected to the end of the second radiating section away from the first radiating section; the fourth radiating section is perpendicularly connected to the end of the third radiating section away from the second radiating section and extends along a direction parallel to the second side portion to form a U-shaped structure with the second radiating section and the third radiating section; the fifth radiating section is perpendicularly connected to the fourth radiating section away from the third radiating section and extends along a direction parallel to the third radiating section towards the second radiating section to form a U-shaped structure with the third radiating section and the fourth radiating section.

39. The wireless communication device of claim 38, wherein when the first feed portion supplies current, the current flows through the first radiating portion and is grounded through the first ground portion; when the first feed portion supplies current, the current flows through the second radiating portion and is grounded through the second ground portion; the first radiating portion and the second radiating portion cooperatively activate the first operation mode to generate radiation signals in a first frequency band; when the second feed portions supplies current, the current flows through the radiator and is coupled to the second portion, the second portion activates the second operation mode to generate radiation signals in a second frequency band; when the current flows through the radiator, the radiator further activates a third operation mode to generate radiation signals in a third frequency band.

40. The wireless communication device of claim 39, wherein the first operation mode is a LTE mode, the second operation mode is a GPS/GLONASS mode, and the third frequency band comprises a high frequency band of the first operation mode, a Bluetooth frequency band, and a WIFI frequency band.

41. The wireless communication device of claim 40, wherein the second feed portion comprises a diplexer and a signal extractor, two output ends of the diplexer provides the WIFI 2.4G signals and LTE high frequency band signals to share a signal output/input path; the signal extractor provides GPS/GLONASS signals and non GPS/GLONASS signals to share a signal output/input path.

42. The wireless communication device of claim 40, wherein the second feed portion comprises a triplexer, the triplexer provides GPS/GLONASS signals and non GPS/GLONASS signals to share a signal output/input path.

* * * * *